US007636528B2

(12) United States Patent
Sato et al.

(10) Patent No.: US 7,636,528 B2
(45) Date of Patent: Dec. 22, 2009

(54) IMAGE-FORMING DEVICE INCLUDING IMAGE-FORMING SECTION, PAPER SUPPLY UNIT, AND DISCHARGE UNIT AND ORNAMENTAL MEMBER THEREFOR

(75) Inventors: Shougo Sato, Seto (JP); Yasushi Okabe, Nagoya (JP); Shigeharu Katayama, Kakamigahara (JP); Yasutake Yamaguchi, Chiryu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 309 days.

(21) Appl. No.: 11/277,483

(22) Filed: Mar. 24, 2006

(65) Prior Publication Data

US 2006/0221170 A1 Oct. 5, 2006

(30) Foreign Application Priority Data

Mar. 30, 2005 (JP) ..... 2005-099848
Mar. 30, 2005 (JP) ..... 2005-099851

(51) Int. Cl.
*G03G 15/00* (2006.01)

(52) U.S. Cl. ..... 399/107; 399/124; 399/393; 399/405

(58) Field of Classification Search ..... 399/107, 399/124, 393, 405
See application file for complete search history.

(56) References Cited

U.S. PATENT DOCUMENTS 5,884,117 A 3/1999 Tanoue et al.
5,953,559 A 9/1999 Obu
6,011,940 A * 1/2000 Van Lydegraf ..... 399/405
6,473,152 B1 * 10/2002 Yokota ..... 399/107

(Continued)

FOREIGN PATENT DOCUMENTS

JP H2 8099 1/1990

(Continued)

OTHER PUBLICATIONS

Japanese Patent Office, Office Action in Japanese Patent Application No. 2005-099848 (counterpart to above-captioned U.S. patent application), mailed Jun. 17, 2008 (including partial translation).

*Primary Examiner*—David M Gray
*Assistant Examiner*—Ryan D Walsh
(74) *Attorney, Agent, or Firm*—Baker Botts, LLP.

(57) ABSTRACT

An image-forming device includes: a casing; an image-forming section including a plurality of image-forming units; a paper supply unit; and a discharge unit. The plurality of image-forming units are arranged substantially vertically within the casing when the casing is disposed in an orientation in which it is intended to be used, each image-forming unit forming an image in a corresponding color. The paper supply unit is disposed above the image-forming units when the casing is disposed in the orientation in which it is intended to be used. The paper supply unit is configured to accommodate a recording medium substantially in a vertical orientation and to supply the recording medium to the image-forming section. The discharge unit is disposed above the image-forming units when the casing is disposed in the orientation in which it is intended to be used. The discharge unit is configured to receive the recording medium discharged from the image-forming section substantially in a vertical orientation.

24 Claims, 15 Drawing Sheets

U.S. PATENT DOCUMENTS

| | | | | |
|---|---|---|---|---|
| 6,511,241 | B2 * | 1/2003 | Fetherolf et al. | 400/664 |
| 6,557,992 | B1 | 5/2003 | Dwyer et al. | |
| 6,798,430 | B2 * | 9/2004 | Sato | 399/401 |
| 6,899,422 | B2 | 5/2005 | Strowe et al. | |
| 2002/0063072 | A1 * | 5/2002 | Pham | 206/320 |
| 2004/0081596 | A1 * | 4/2004 | Hsi | 422/186.3 |
| 2004/0246326 | A1 | 12/2004 | Dwyer et al. | |
| 2006/0024094 | A1 * | 2/2006 | Uehara | 399/299 |
| 2006/0291931 | A1 * | 12/2006 | Kobayashi | 399/392 |
| 2008/0159778 | A1 * | 7/2008 | Kim et al. | 399/107 |

FOREIGN PATENT DOCUMENTS

| | | | |
|---|---|---|---|
| JP | H06-095444 | A | 4/1994 |
| JP | H07-334065 | A | 12/1995 |
| JP | H8 121431 | | 5/1996 |
| JP | H8 160691 | | 6/1996 |
| JP | H08-190245 | | 7/1996 |
| JP | H08-295447 | A | 11/1996 |
| JP | H9 222763 | | 8/1997 |
| JP | H10 20595 | | 1/1998 |
| JP | H10 319662 | | 12/1998 |
| JP | H11 84883 | | 3/1999 |
| JP | H11 184357 | | 7/1999 |
| JP | 2000 66607 | | 3/2000 |
| JP | 2001 109325 | | 4/2001 |
| JP | 2001 213021 | | 8/2001 |
| JP | 2001 246807 | | 9/2001 |
| JP | 2001 277671 | | 10/2001 |
| JP | 2004 29565 | | 1/2004 |
| JP | 2004 31955 | | 1/2004 |
| JP | 2005035137 | A * | 2/2005 |

* cited by examiner

IMAGE-FORMING DEVICE INCLUDING IMAGE-FORMING SECTION, PAPER SUPPLY UNIT, AND DISCHARGE UNIT AND ORNAMENTAL MEMBER THEREFOR

CROSS REFERENCE TO RELATED APPLICATIONS

This application claims priority from Japanese Patent Application Nos. 2005-99848 filed Mar. 30, 2005 and 2005-99851 filed Mar. 30, 2005. The entire content of each of these priority applications is incorporated herein by reference.

TECHNICAL FIELD

The disclosure relates to an image-forming device such as a color laser printer.

BACKGROUND

Usually conventional laser printers include a developer unit, photosensitive drum, and the like. The laser printer forms an image on paper by supplying developer to the photosensitive drum for developing an electrostatic latent image formed on the surface of the photosensitive drum and by transferring the toner image onto paper.

With this type of conventional laser printer, the aforementioned developer unit, photosensitive drum, and the like are accommodated in a casing. The casing is provided with a cover for covering or exposing the interior of the casing. The user can open the cover in order to resolve paper jams, or replace the developer unit and photosensitive drum.

Normally, the casing is covered with an exterior cover formed of synthetic resin. However, the appearance of such a cover can decline relatively quickly due to dirt from hands or the like and scratches due to the opening and closing operations of the cover and like.

For this reason, exterior covers such as that disclosed in Japanese unexamined patent application publication No. HEI-9-222763 have been proposed. In this proposal, an exterior cover is detachably mounted on the body of the image-forming device, on the surface facing the user. This exterior cover has engaging parts, such as engaging holes forming the same shape in the same position on the front and rear surfaces of the exterior cover as viewed from she front when the exterior cover is inverted laterally, that is, in the right-to-left direction. This construction enables both the front and rear surfaces of the exterior cover to be used as the outer surface.

However, only the front and rear surfaces of the exterior cover described above can be used as the outer surface by flipping the cover laterally, that is, in the right-to-left direction. Hence, the conventional problem has not been solved since the exterior cover still easily becomes dirty or scratched and the exterior appearance of the cover cannot easily be maintained over a long period of time.

One type of conventional color laser printers well known in the art is a tandem type printer that includes four photosensitive drums corresponding to the colors yellow, magenta, cyan, and black. Electrostatic latent images formed on each photosensitive drum are developed in the respective color to form a color toner image on the photosensitive drum. Subsequently, each toner gage is transferred onto paper.

Of these tandem-type color laser printers, there have been proposed direct tandem printers having four image-forming units juxtaposed at intervals horizontally, each image-forming unit including a photosensitive drum and a developing unit, whereby a paper is conveyed horizontally so as to sequentially contact the photosensitive drum in each image-forming unit, and the image in each color is directly transferred onto the paper. Another proposed color laser printer is an intermediate transfer tandem printer having an intermediate transfer belt disposed horizontally and in confrontation with each image-forming unit, whereby the images of each color are temporarily transferred onto the intermediate transfer belt and all images are subsequently transferred at once from the intermediate transfer belt to the paper.

However, when four image-forming units are juxtaposed horizontally, a much larger footprint is required for the printer than a monochrome printer that has a single image-forming unit.

Full-color image-forming devices have been proposed to overcome this problem, such as that disclosed in Japanese unexamined patent application publication No. 2001-109325. This image-forming device has four independent image-forming stations PY, PM, PC, and PK, each having a photosensitive drum, a developing unit, a cleaning device, and the like. The image-forming stations are arranged vertically along an upward moving side of a vertically arranged transfer belt. Paper attracted to the transfer belt to each of the stations PY-PK, at which time the stations PY-PK sequentially superpose toner images in their respective colors on the paper to form a full-color image.

Since the image-forming stations in the image-forming device according to Japanese unexamined patent application publication No. 2001-109325 are juxtaposed vertically, the footprint of the image-forming device is less than that of a device having stations juxtaposed horizontally.

SUMMARY

It is an object of the invention to provide an image-forming device capable of maintaining the external appearance of an exterior cover over a long period of time.

It is another object of the invention to provide a more compact image-forming device having a plurality of image-forming units and capable of further reducing the footprint of the image-forming device.

In order to attain the above and other objects, the invention provides an image-forming device including: a casing; an image-forming section including a plurality of image-forming units; a paper supply, unit; and a discharge unit. The plurality of image-forming units are arranged substantially vertically within the casing when the casing is disposed in an orientation in which it is intended to be used, each image-forming unit forming an image in a corresponding color. The paper supply unit is disposed above the image-forming units when the casing is disposed in the orientation in which it is intended to be used. The paper supply unit is configured to accommodate a recording medium substantially in a vertical orientation and to supply the recording medium to the image-forming section. The discharge unit is disposed above the image-forming units when the casing is disposed in the orientation in which it is intended to be used. The discharge unit is configured to receive the recording medium discharged from the image-forming section substantially in a vertical orientation.

According to another aspect, the invention provides an image-forming device including: a casing; an image-forming section that forms an image on a recording medium; and an ornamental member mounted on the casing, the ornamental member having an ornamental layer formed of a material selected from wood, fibers, and foam material.

According to another aspect, the invention provides an ornamental member that is capable of being used for covering at least a portion of a casing provided for an image-forming device, the ornamental member including an ornamental layer formed of a material selected from wood, fibers, and foam material.

According to another aspect, the invention provides a set of a plurality of ornamental members, each of which is capable of being used for covering at least a portion of a casing provided for an image-forming device, the ornamental member including an ornamental layer formed of a material selected from wood, fibers, and foam material, the ornamental layer in at least one ornamental member having a different design from the ornamental layer in another ornamental member.

According to another aspect, the invention provides a method of changing an external appearance of an image-forming device, including: preparing a set of a plurality of ornamental members, each of which is capable of being used for covering at least a portion of a casing provided for an image-forming device, the ornamental member comprising an ornamental layer formed of a material selected from wood, fibers, and foam material, the ornamental layer in at least one ornamental member having a different design from the ornamental layer in another ornamental member; mounting the one ornamental member to the casing; and replacing the one ornamental member with another ornamental member whose ornamental layer has a different design from the ornamental layer in the one ornamental member.

DETAILED DESCRIPTION

Figure 1:
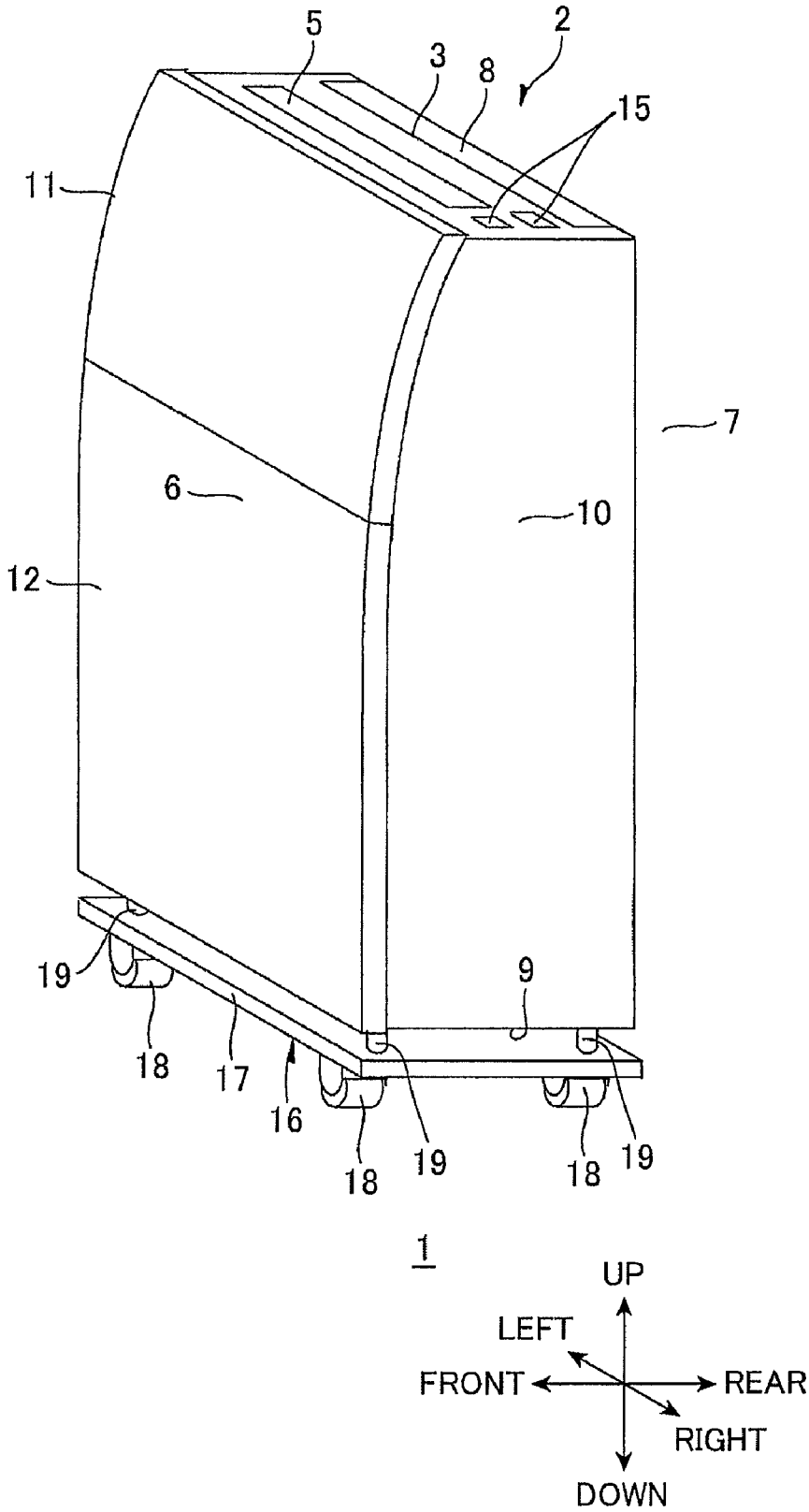
FIG. 1 is a perspective view from a front surface side illustrating a color laser printer according to a first embodiment of the invention.

An image-forming device according to embodiments of the invention will be described while referring to the accompanying drawings wherein like parts and components are designated by the same reference numerals to avoid duplicating description.

First Embodiment

A color laser printer according to a first embodiment of the invention will be described with reference to FIGS. 1-4.

A. General Structure of a Color Laser Printer

As shown in FIG. 1, a color laser printer 1 of the first embodiment is a vertical direct tandem printer. The printer 1 includes a casing 2 and, within the casing 2, a paper supply unit 3, an engine unit 4 (see FIG. 3), and a discharge unit 5.

In the following description, the terms "upward", "downward", "upper", "lower", "above", "below", "beneath", "front", "rear", "right", and "left", and the like will be used throughout the description assuming that the color laser printer 1 is disposed in an orientation in which it is intended to be used. In use, the color laser printer 1 is disposed as shown in FIG. 1.

B. Casing

The casing 2 is formed of a hard synthetic resin. As shown in FIG. 1, the casino 2 includes a rear wall 7, a top wall 8, a bottom wall 9, and side walls 10 that are integrally formed in a box shape with an opened front surface 6. More specifically, the front edges of the top wall 8, bottom wall 9, and side walls 10 define the opened front surface 6. The casing 2 has no protruding parts, is long vertically, narrow in the front-to-rear direction, and thick in the width direction (the direction orthogonal to the vertical direction and the front-to-rear direction) and, hence, has a tall, slender structure that is stable. Further, while the rear wall 7 is entirely flat, the upper portion of the front surface 6 curves rearward (toward the rear wall 7 side) toward the top thereof.

Further, an upper cover 11 and a lower cover 12 are provided on the front surface 6 of the casing 2.

The upper cover 11 is disposed in the top section of the front surface 6 opposing the discharge unit 5 in the front-to-rear direction. The upper cover 11 is also formed of a hard synthetic resin and is shaped substantially rectangular in a front view, but curves rearward (toward the rear wall 7 side) toward the top thereof. An upper shaft 13 (see FIG. 3) extending in the width direction is provided on the lower edge of the upper cover 11 on the front surface of the casing 2 and is rotatably supported in both side walls 10 of the casing 2.

The lower edge of the upper cover 11 is attached to the upper shaft 13, and the upper cover 11 is pivotably supported on the front surface 6 of the casing 2 via the upper shaft 13 so that the top edge can move in a front-to-rear direction about the upper shaft 13 on the lower edge. By moving the upper edge of the upper cover 11 forward about the lower edge, the upper cover 11 is opened to expose the discharge unit 5, as indicated by the dotted line in FIG. 3. Further, by moving the upper edge of the upper cover 11 rearward about the lower edge, the upper cover 11 is closed to cover the discharge unit 5, as indicated by the solid line in FIG. 3.

The lower cover 12 is disposed in the lower section of the front surface 6 below the upper cover 11 so as to oppose the engine unit 4 in the front-to-rear direction. The lower cover 12 is also formed of a hard synthetic resin in the shape of a rectangle from a front view. A lower shaft 14 extending in the width direction is provided on a lower edge of the lower cover 12 and is rotatably supported in both side walls 10 of the casing 2 on the front surface 6 thereof.

The lower edge of the lower cover 12 is attached to the lower shaft 14, and, the lower cover 12 is pivotably supported on the front surface 6 of the casing 2 via the lower shaft 14 so that an upper edge of the lower cover 12 can move in the front-to-rear direction about the lower shaft 14 on the lower edge. By moving the upper edge of the lower cover 12 forward about the lower edge, the lower cover 12 is opened to reveal the engine unit 4, as indicated by the dotted line in FIG. 3. Further, by moving the upper edge of the lower cover 12 rearward about the lower edge, the lower cover 12 is closed to cover the engine unit 4, as indicated by the solid line in FIG. 3.

A transfer unit 35 described later is fixed to the inside of the lower cover 12 and moves together with the lower cover 12 when the lower cover 12 is opened and closed (see FIG. 3).

Further, a control panel 15 is disposed on the top wall 8 of the casing 2 for performing operations on the printer 1. The control panel 15 includes a liquid crystal panel for displaying the operating state of the printer 1, and buttons that the user can operate to set various conditions.

The casing 2 is also mounted on a mount 16. The mount 16 includes a support plate 17, casters 18, support rods 19, and a height adjustment mechanism 20 (see FIG. 2).

The support plate 17 has a substantially rectangular plate shape in a plan view with slightly larger area than the bottom wall 9 of the casing 2. The casters 18 are provided on the bottom surface of the support plate 17.

Figure 2:
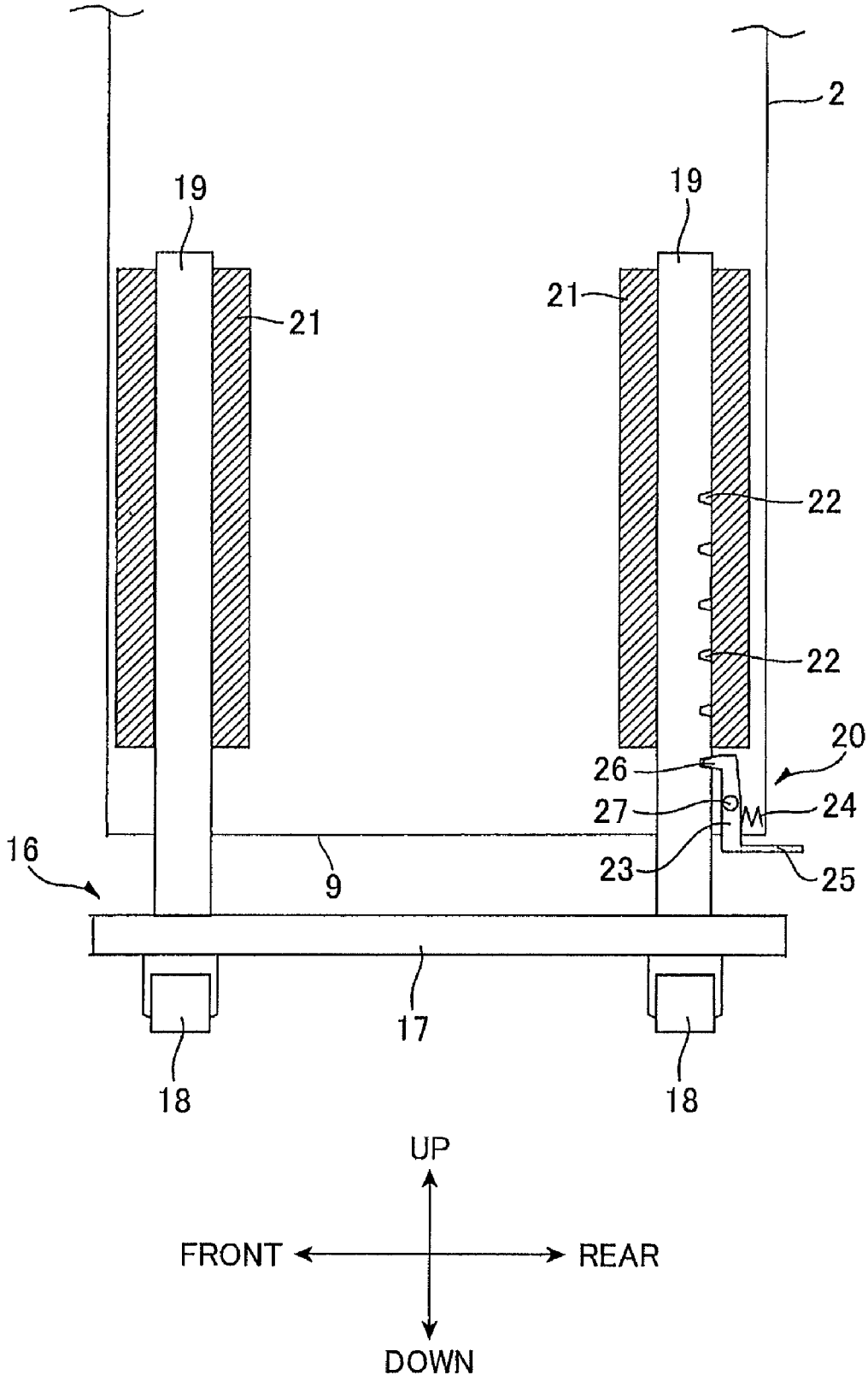
FIG. 2 is a schematic diagram illustrating a height adjustment mechanism for the color laser printer of FIG. 1.

Each caster 18 includes a roller capable of rolling. The casters 18 are disposed in each of the four corners of the support plate 17 with the rolling direction of the rollers fixed so that the casing 2 can only be moved in the widthwise direction, that is, in the right-and-left direction. The support rods 19 are erected from the top surface of the support plate 17 in each of the four corners thereof. As shown in FIG. 2, a plurality of engaging holes 22 are formed in one support rod 19 at intervals in the vertical direction. The engaging holes 22 serve to engage with an engaging pawl 26 described later of the height adjustment mechanism 20. Cylinders 21 are disposed in a vertical orientation in each corner of the casing 2 at positions corresponding to the support rods 19 for receiving the support rods 19 therein. Each support rod 19 is capable of being slidingly inserted into the respective cylinder 21.

The height adjustment mechanism 20 is provided in the casing 2 near the bottom wall 9 corresponding to the support rod 19 that is formed with the engaging holes 22. The height adjustment mechanism 20 includes an engaging lever 23 and a tension spring 24.

The engaging lever 23 is substantially Z-shaped in a side view. The engaging pawl 26 is formed on one end of the engaging lever 23 protruding in one direction, while a grip part 25 is formed on the other end of the engaging lever 23 and extends in another direction opposite the protruding direction of the engaging pawl 26. A support shaft 27 is fixed inside the casing 2 near the bottom wall 9. The support shaft 27 rotatably fixes the engaging lever 23 in a center portion thereof. The engaging lever 23 is fixed so that the engaging pawl 26 opposes the engaging holes 22 in the support rod 19, and the grip part 25 protrudes out of the casing 2 through the bottom wall 9.

One end of the tension spring 24 is fixed to a portion of the engaging lever 23 between the center portion and the grip part 25, while the other end is fixed to an inner surface of the casing 2 opposing this portion. The urging force of the tension spring 24 constantly urges the engaging lever 23 to rotate in a direction that inserts the engaging pawl 26 into one of the engaging holes 22 in the support rod 19. When the grip part 25 of the engaging lever 23 is pressed, the enraging lever 23 rotates about the support shaft 27 against the culling force of the tension spring 24 in a direction that separates the engaging pawl 26 from the engaging hole 22.

When the grip part 25 is dressed to separate the engaging pawl 26 from the engaging hole 22, the support rod 19 can be slid within the cylinder 21, enabling the user to adjust the vertical position of the casing 2 over the mount 16. Hence, in this state, the support rods 19 are slid vertically in the cylinders 21 until the casing is adjusted to a desired height, and the engaging hole 22 corresponding to this height opposes the engaging pawl 26. At this time, the user releases the grip part 25, allowing the pulling force of the tension spring 24 to insert the engaging pawl 26 into the engaging hole 22 so that the casing 2 is now supported on the mount 16 at the newly adjusted height.

In the above description, the engaging holes 22 are formed on only one of the four support rods 19. However, the engaging holes 22 may be formed on two or more support rods 19. In this case, two or more sets of height adjustment mechanism 20 are provided in one to one correspondence with the two or more support rods 19 that are formed with the engaging holes 22. For example, the engaging holes 22 may be formed on all of the four support rods 19. In this case, four sets of height adjustment mechanism 20 are provided in one to one correspondence with the four support rods 19.

Further, the casing 2 supported on the mount 16 can be moved only in the widthwise direction (right-and-left direction) by the casters 18.

C. Paper Supply Unit

Figure 3:
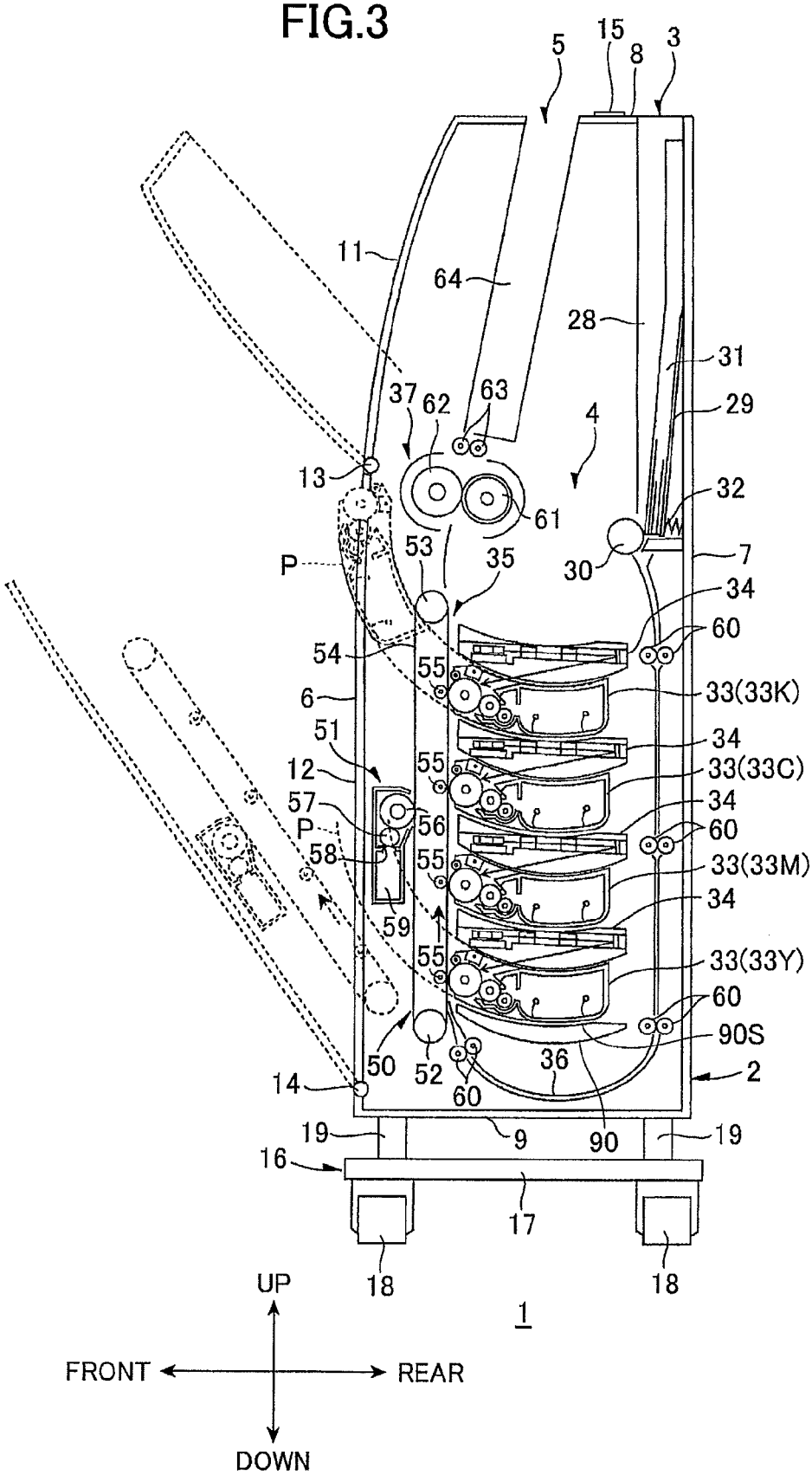
FIG. 3 is a side cross-sectional view of the color laser printer in FIG. 1.

As shown in FIG. 3, the paper supply unit 3 is disposed in the rear side of the casing 2 above process units 33 described later in the engine unit 4. The paper supply unit 3 includes a paper holder 28 for accommodating a paper 31, a paper-pressing plate 29 disposed inside the paper holder 28, and a feeding roller 30 disposed at the front lower end of the paper holder 28.

The paper holder 28 is configured of a cassette having a bottom and an open top and capable of accommodating the paper 31. The paper holder 28 is detachably mounted in the casing 2 in a vertical direction through the top wall 8.

The paper-pressing plate 29 is disposed in the paper holder 28 and extends from a vertical midpoint to a lower end of the paper holder 28. The upper end of the paper-pressing plate 29 is rotatably supported on the rear surface of the paper holder 28. A compressed spring 32 is disposed on the rear surface of the paper-pressing plate 29 at the lower end thereof for urging the lower end of the paper-pressing plate 29 forward.

The feeding roller 30 is disposed in confrontation with the lower end of the paper-pressing plate 29 as the paper-pressing plate 29 is urged forward by the compressed spring 32.

The paper 31 is maintained substantially in a vertical orientation in the paper holder 28 on the front side of the paper-pressing plate 29 and is stacked in a front-to-rear direction opposing the urging force of the compressed spring 32. That is, each sheet extends substantially vertically in the paper holder 28, with its thickness direction being substantially parallel to the front-to-rear direction of the printer 1. The forwardmost sheet of the paper 31 stacked on the front side of the paper-pressing plate 29 is pressed against the feeding roller 30 by the urging force of the compressed spring 32. The feeding roller 30 rotates to feed the caper 31 toward the engine unit 4 one sheet at a time.

D. Engine Unit

The engine unit 4 includes a plurality of the process units 33, a plurality of scanning units 34, the transfer unit 35, a conveying path 36, and a fixing unit 37.

a. Process Units

In the present embodiment, four of the process units 33 are provided in the casing 2 for each of four different colors. The process units 33 are positioned below the paper supply unit 3 and discharge unit 5 and are detachably mounted in the casing 2. More specifically, the process units 33 include a yellow process unit 33Y, magenta process unit 33M, cyan process unit 33C, and black process unit 33K. These process units 33 are vertically stacked in the casing 2 from bottom to top in the order given and are separated from each other by a prescribed distance.

By opening the lower cover 12 to the position indicated by the dotted line, each process unit 33 can be independently mounted in or removed from the casing 2 in the front-to-rear direction. The mounted process units 33 are covered when the lower cover 12 is closed in the position indicated by the solid line.

Further, when the process unit 33 is being removed from the casing 2, the process unit 33 follows a curved path P that breaks the plane of the front surface 6 that is opened by the lower cover 12 and that arcs upward along the front surface 6 outside the casing 2, as indicated by the dotted line.

The following description of the process units 33 is based on the arrangement when the process units 33 are mounted in the casing 2.

Figure 4:
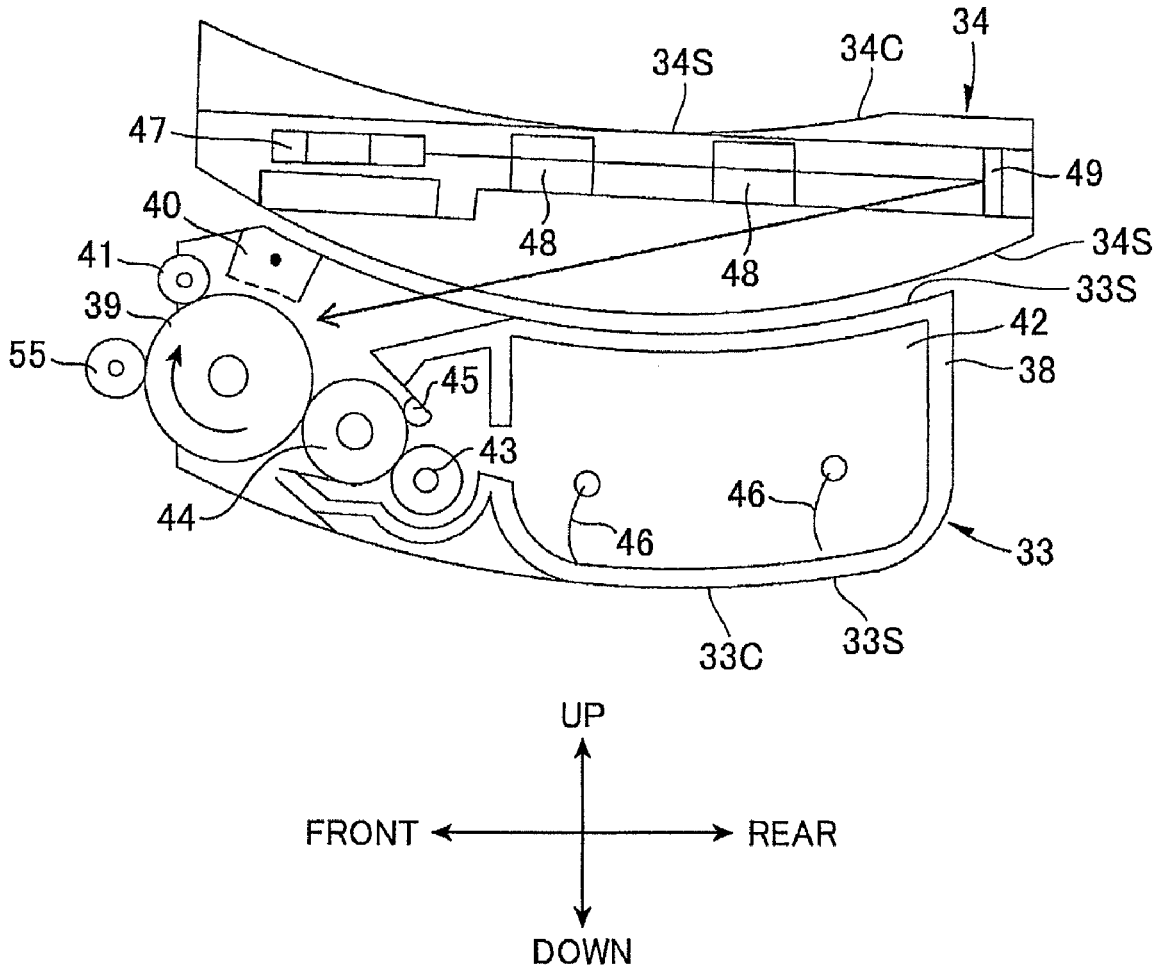
FIG. 4 is an enlarged side cross-sectional view of a process unit and scanning unit shown in FIG. 3.

As shown in FIG. 4, each process unit 33 includes a casing 33*c* with a pair of opposite arcing surfaces 33*s*, and, within the casing 33*c*, a developer cartridge 38, a photosensitive drum 39, a Scorotron charger 40, and a drum cleaning roller 41.

The developer cartridge 38 is located in the rear section of the casing 33*c*, and includes a toner-accommodating section 42, a supply roller 43, a developing roller 44, and a thickness-regulating blade 45.

The toner-accommodating section 42 is configured of internal space in the rear section of the developer cartridge 38. Two agitators 46 separated from each other in the front-to-rear direction are disposed in the toner-accommodating section 42. Each toner-accommodating section 42 is filled with a nonmagnetic, single-component toner having a positive charging nature and of a color corresponding to the process units 33. In other words, the toner-accommodating section 42 of the yellow process unit 33Y accommodates yellow toner, the toner-accommodating section 42 of the magenta process unit 33M accommodates magenta toner, the toner-accommodating section 42 of the cyan process unit 33C accommodates cyan toner, and the toner-accommodating section 42 of the black process unit 33K accommodates black toner.

The toner used in the present embodiment is substantially spherical polymerized toner obtained by copolymerizing a polymerized monomer using a well-known polymerization method, such as suspension polymerization. The polymerized monomer may be, for example, a styrene monomer such as styrene or an acrylic monomer such as acrylic acid, alkyl (C1-C4) acrylate, or alkyl (C1-C4) meta acrylate. This type of toner is compounded with a coloring agent, such as carbon black, or wax, as well as an additive such as silica to improve fluidity. The average diameter of the toner particles is about 6-10 μm.

The agitators 46 disposed in the toner-accommodating section 42 rotate and agitate the toner accommodated in the toner-accommodating section 42. Some of the agitated toner is discharged through a toner supply opening formed in the front side of the toner-accommodating section 42 and supplied to the supply roller 43.

The supply roller 43 is rotatably disposed in front of the toner supply opening. The supply roller 43 includes a metal roller shaft covered by an electrically conductive sponge roller.

The developing roller 44 is disposed to the front side of the supply roller 43 and is capable of rotating while in confrontation with the supply roller 43. The developing roller 44 contacts the supply roller 43 with pressure so that the supply roller 43 is compressed to a degree.

The developing roller 44 is configured of a metal roller shaft covered by an electrically conductive rubber roller. More specifically, the rubber roller portion of the developing roller 44 has a two-layer structure including a resilient roller formed of an electrically conductive urethane rubber, silicone rubber, or EPDM rubber including fine carbon particles or the like, and a coating covering the surface of the resilient roller and having as the primary component urethane rubber, urethane resin, polyimide resin, or the like. The developing roller 44 is positioned so that a front part thereof is exposed through an opening formed in a front part of the developer cartridge 38. During a developing operation, a power supply (not shown) applies a developing bias to the developing roller 44.

The thickness-regulating blade 45 is configured of a main blade member formed of a metal leaf spring member, and a pressing part provided on the distal end of the main blade member. The pressing part has a semicircular cross section and is formed of an insulating silicone rubber. A base end of the main blade member is supported on the developer cartridge 38 near the top of the developing roller 44 so that the pressing part contacts the surface of the developing roller 44 with pressure through the elastic force of the main blade member.

Toner discharged through the toner supply opening is supplied onto the developing roller 44 by the rotating supply roller 43. At this time, the toner is positively tribocharged between the supply roller 43 and the developing roller 44. As the developing roller 44 rotates, toner carried on the surface of the developing roller 44 passes beneath the pressing part of the thickness-regulating blade 45 so that a thin layer of uniform thickness is carried on the developing roller 44.

The photosensitive drum 39 is disposed on the front side of the developing roller 44 and is capable of rotating in the process unit 33 while in contact with the developing roller 44. The photosensitive drum 39 is configured of a grounded main drum body, the surface of which is coated with a photosensitive layer formed of an organic material with polycarbonate as the main component. The photosensitive drum 39 is positioned so that a front portion of the photosensitive drum 39 is exposed through an opening formed in the front side of the process unit 33.

The charger 40 is disposed above the photosensitive drum 39 with a prescribed amount of separation so as not to contact the photosensitive drum 39, The charger 40 is a positive charging Scorotron charger having a charging wire formed of tungsten from which a corona discharge is generated. The charger 40 is fixed to the process unit 33 so as to charge the entire surface of the photosensitive drum 39 with a uniform positive polarity.

The drum cleaning roller 41 is rotatably disposed in the process unit 33 so as to contact the photosensitive drum 39 at a position upstream of the charger 40 with respect to the rotational direction of the photosensitive drum 39. The drum cleaning roller 41 is configured of a metal roller shaft that is covered with an electrically conductive rubber roller. During a cleaning operation, a power supply (not shown) applies a cleaning bias to the drum cleaning roller 41.

With this construction, exposure and developing operations for each color of toner are performed by each process unit 33 in the following manner. As the photosensitive drum 39 rotates, the charger 40 generates a positive charge over the entire surface of the photosensitive drum 39. Subsequently, the surface of the photosensitive drum 39 is exposed to the high-speed scanning of a laser beam emitted from the scanning unit 34 described in more detail later, forming an electrostatic latent image on the surface of the photosensitive drum 39 based on prescribed image data. Next, the positively charged toner carried on the surface of the developing roller 44 is brought into contact with the photosensitive drum 39 as the developing roller 44 rotates. At this time, the latent image formed on the surface of the photosensitive drum 39 is developed into a toner image when the toner is selectively attracted to portions of the photosensitive drum 39 that have been exposed to the laser beam and, therefore, have a lower potential than the rest of the surface, which has a uniform positive charge. In this way, a toner image is formed through a reverse development process.

b. Scanning Unit

As shown in FIG. 3, the scanning units 34 are disposed in the casing 2 below the paper supply unit 3 and discharge unit 5. Four of the scanning units 34 are fixed to the casing 2 at positions corresponding to the process units 33 provided for each color. The scanning units 34 are arranged to be stacked vertically at prescribed intervals so that each scanning unit 34 is disposed above the corresponding process unit 33. Hence, the process units 33 and scanning units 34 are alternately stacked in the vertical direction within the casing 2.

As shown in FIG. 4, each scanning unit 34 includes a casing 34*c* with upper and lower guiding surfaces 34*s*. Each scanning unit 34 includes, within the casing 34*c*, a laser light-emitting unit (not shown), a polygon mirror 47 that can be driven to rotate, two lenses 48, and a reflecting mirror 49.

With this construction, the laser-light emitting unit (not shown) of the scanning unit 34 emits a laser beam based on prescribed image data. As indicated by the arrow in FIG. 4, the laser beam sequentially passes through or is reflected by the polygon mirror 47, the two lenses 48, and the reflecting mirror 49 and is subsequently irradiated in a high-speed scan onto the surface of the respective photosensitive drum 39, as described above.

As described above, the four scanning units 34 are arranged in line in the vertical direction in the casing 2 and are spaced from one another at intervals. A guiding member 90 is disposed below the lowermost scanning unit 34 in the casing 2. The guiding member 90 is spaced from the lowermost scanning unit 34 at an interval. The process units 33 are mounted in the casing 2 so that each of the process units 33K, 33C, and 33M is disposed between neighboring two scanning units 34 and so that the process unit 33Y is disposed between the lowermost scanning unit 34 and the guiding member 90. Each scanning unit 34 has the upper and lower guiding surfaces 34*s* disposed on opposite sides in the vertical direction. These upper and lower guiding surfaces 34*s* form concentric arcs that curve with the convex part facing downward. The upper and lower guiding surfaces 34*s* follow the curved path P that forms an arcing shape to pass through the opened front surface 6 and that curves to extend in a vertical line along the front surface 6 of the casing 2 outside the casing 2. The guiding member 90 has an upper guiding surface 90*s* that also forms an arc curving with the convex part facing downward. The upper guiding surface 90*s* follows the curved path P. The casing 33*c* of each process unit 33 has the pair of opposite arcing surfaces 33*s* which are separated from each other. The pair of opposite arcing surfaces 33*s* are formed with arc-shaped cross sections that are concentric with each other and that can follow the curved path P.

As shown in FIG. 3, when mounting or removing one of the process units 33K, 330C, and 33M, the process unit 33 is guided by its upper and lower neighboring scanning units 34 so that the upper and lower surfaces of the casing 33*s* slide against opposing scanning units 34. When mounting or removing the process unit 33Y, the process unit 33Y is guided by its upper neighboring scanning unit 34 and its lower guiding member 90 so that the upper and lower surfaces of the casing 33*s* slide against the upper scanning unit 34 and the guiding member 90, respectively. Accordingly, each process unit 33 is guided along the curved path P.

c. Transfer Unit

As shown in FIG. 3, the transfer unit 35 is provided in the casing 2 between the process units 33 and the lower cover 12. The transfer unit 35 is oriented vertically so as to oppose each of the process units 33 stacked vertically in the casing 2. The transfer unit 35 includes a transfer belt unit 50, and a belt cleaner unit 51.

The transfer belt unit 50 extends vertically so as to oppose each of the photosensitive drums 39, which are arranged to be stacked vertically. The transfer belt unit 50 includes a drive roller 53, a follow roller 52, a conveying belt 54, and transfer rollers 55.

The follow roller 52 is disposed lower than the photosensitive drum 39 of the lowest yellow process unit 33Y. The drive roller 53 is disposed higher than the photosensitive drum 39 of the highest black process unit 33K and below the fixing unit 37.

The conveying belt 54 is formed of an electrically conductive polycarbonate, polyimide, or the like diffused with electrically conductive carbon particles or the like. The conveying belt 54 is looped around the drive roller 53 and follow roller 52 so that the outer surface of the conveying belt 54 on the rearward facing side contacts all of the photosensitive drums 39 in the process units 33.

When the drive roller 53 is driven to rotate, the follow roller 52 follows this rotation as the conveying belt 54 circulates around the drive roller 53 and follow roller 52 so that the outer surface of the conveying belt 54 on the rear side contacting the photosensitive drums 39 moves in the same direction as the surfaces of the photosensitive drums 39 at the contact points.

The transfer rollers 55 are disposed inside the conveying belt 54 at positions opposing the photosensitive drums 39 so as to pinch the conveying belt 54 therebetween. Each transfer roller 55 is configured of a metal roller shaft that is covered with an electrically conductive rubber roller. The transfer rollers 55 are disposed in contact with the inner surface of the conveying belt 54 on the rear side and rotate in a direction conforming to the circular movement of the conveying belt 54. During a transfer operation, a power supply (not shown) applies a transfer bias to the transfer rollers 55.

The belt cleaner unit 51 is disposed on the opposite side (front side) of the looped conveying belt 54 from the photosensitive drums 39 and is positioned vertically between the drive roller 53 and follow roller 52. The belt cleaner unit 51 includes a cleaning roller 56, a recovery roller 57, a scraper 58, and a recovery box 59.

The cleaning roller 56 is configured of a metal roller shaft covered by an electrically conductive rubber roller. The cleaning roller 56 is disposed in contact with the outer surface of the conveying belt 54 on the front side thereof and is rotatably disposed in the belt cleaner unit 51 so as to rotate in a direction that conforms to the circular movement of the conveying belt 54 on the front side. During a cleaning operation, a power supply (not shown) applies a primary cleaning bias to the cleaning roller 56.

The recovery roller 57 is configured of a metal roller shaft that is covered by an electrically conductive rubber roller. The recovery roller 57 is disposed below the cleaning roller 56 and in contact with the same, and is rotatably disposed in the belt cleaner unit 51. During a cleaning operation, a power supply (not shown) applies a secondary cleaning bias to the recovery roller 57.

The recovery box 59 is disposed below the recovery roller 57 and is open on the side opposing the recovery roller 57. The scraper 58 is disposed near the open portion of the recovery box 59 and contacts the surface of the recovery roller 57 with pressure.

The transfer unit 35 is integrally supported on the lower cover 12 of the casing 2. Therefore, when the lower cover 12 is opened, the transfer unit 35 moves together with the lower cover 12 and separates from the process units 33, as indicated by the dotted line. When the lower cover 12 is closed, the transfer unit 35 again moves together with the lower cover 12 and contacts the photosensitive drums 39 of the process units 33 with pressure, as indicated by the solid line.

d. Conveying Path

The conveying path 36 is formed from the lower end of the paper supply unit 3 to the lower rear corner of the process units 33 in the rear section of the casing 2. From this point, the conveying path 36 describes a U-shaped path that passes beneath and around the lowermost yellow process unit 33Y. Now in the front section of the casing 2, the conveying path 36 continues upward between the conveying belt 54 and the photosensitive drums 39 of the process units 33. The paper 31 is conveyed along this conveying path 36.

A plurality of conveying rollers 60 are provided along the conveying path 36 in the rear and lower sections of the casing 2 for conveying the paper 31 through these rear and lower sections of the conveying path 36. In the front section of the conveying path 36, the conveying belt 54 conveys the paper 31.

e. Fixing Unit

The fixing unit 37 is disposed in the casing 2 above the uppermost black process unit 33K and the transfer unit 35 and below the discharge unit 5. The fixing unit 37 includes a heating roller 61 and a pressure roller 62.

The heating roller 61 is rotatably supported in the casing 2 and is configured of a metal tube formed of aluminum or the like and a halogen lamp disposed inside the metal tube. The outer surface of the metal tube is treated to prevent toner from depositing thereon.

The pressure roller 62 is positioned on the front side of the heating roller 61 and in confrontation with the same so as to pinch the paper 31 in the front-to-rear direction as the paper 31 passes through the fixing unit 37. The pressure roller 62 is configured of a metal roller shaft that is covered by a rubber roller. The pressure roller 62 is rotatably supported in the casing 2 so as to contact the heating roller 61 with pressure.

f. Image Formation in the Engine Unit

With the above construction, the paper supply unit 3 feeds the paper 31 onto the conveying path 36, and the conveying rollers 60 provided in the rear and lower sections of the conveying path 36 convey the paper 31 downward in the rear section and along the U-shaped curve around the lowermost yellow process unit 33Y. Subsequently, the conveying belt 54 receives and conveys the paper 31 upward in the front section of the conveying path 36.

Specifically, the driving of the drive roller 53 moves the conveying belt 54 circularly as the follow roller 52 follows, and the conveying belt 54 conveys the paper 31 through the front section of the conveying path. The paper 31 is sequentially conveyed between the conveying belt 54 and the photosensitive drum 39 of each process unit 33 at transfer positions therebetween. As the paper 31 passes through these transfer positions, toner images in each color formed on the respective photosensitive drum 39 are sequentially transferred onto the paper 31, forming a full-color image on the paper 31.

For example, first a yellow toner image formed on the photosensitive drum 39 in the yellow process unit 33Y is transferred onto the paper 31. Next, a magenta toner image formed on the photosensitive drum 39 in the magenta process unit 33M is transferred onto the caper 31 and superposed over the previously transferred yellow toner image. In the same way, a cyan toner image and a black toner image formed in the cyan process unit 33C and black process unit 33K, respectively, are transferred onto the paper 31 and superposed over the previously transferred images, thereby completing a full-color image.

For forming these types of full-color images, the printer 1 is configured as a direct tandem printer that transfers full-color images directly onto the paper 31 by providing a photosensitive drum 39 for each color and sequentially placing the paper 31 in contact with each photosensitive drum 39. Accordingly, this printer 1 can form toner images in each color to rapidly form full-color images at approximately the same speed required to form a monochrome image.

After toner images of each color have been transferred onto the paper 31, toner remaining on the surface of the photosensitive drum 39 is temporarily captured by the drum cleaning roller 41. When an image-forming operation is not being performed, the drum cleaning roller 41 returns the toner to the photosensitive drum 39, and the developing roller 44 collects the toner to be reused for image development.

Further, after a full-color image has been transferred onto the paper 31, the toner deposited onto the surface of the conveying belt 54 is attracted to the cleaning roller 56 when the toner confronts the cleaning roller 56 due to the primary cleaning bias applied to the cleaning roller 56. Subsequently, the toner attracted to the cleaning roller 56 is deposited on the recovery roller 57 when the toner confronts the recovery roller 57 due to the secondary cleaning bias applied to the recovery roller 57. Subsequently, the scraper 58 scrapes the toner from the recovery roller 57, and the toner is collected in the recovery box 59.

Once a full-color image has been formed on the paper 31, the paper 31 is conveyed to the fixing unit 37 and the full-color image transferred onto the paper 31 is fixed thereto by the heating roller 61 and pressure roller 62 as the paper 31 passes therebetween. Next, the paper 31 is conveyed to the discharge unit 5.

E. Discharge Unit

The discharge unit 5 is disposed in the casing 2 above and forward of the process units 33 in the engine unit 4. The discharge unit 5 also opposes and is separated a prescribed distance from the paper supply unit 3 horizontally in the front-to-rear direction and opposes the transfer unit 35 of the engine unit 4 vertically. The discharge unit 5 includes discharge rollers 63, and a discharge holder 64.

The discharge rollers 63 are disposed above the fixing unit 37 and below the discharge holder 64. After a full-color image has been fixed by heat to the paper 31 in the fixing unit 37, the discharge rollers 63 receive the paper 31 and discharge the paper 31 into the discharge holder 64.

The discharge holder 64 is provided in the casing 2 as a recessed part formed substantially in the shape of a rectangle when viewed from the front side and is capable of accommodating sheets of the paper 31. The discharge holder 64 is either covered or exposed by the upper cover 11 on the front side of the casing 2.

After the discharge rollers 63 discharge the paper 31, the paper 31 is accommodated in the discharge holder 64 substantially in a vertical orientation. That is, each sheet of paper 31 extends substantially vertically in the discharge holder 64, with its thickness direction being substantially parallel to the front-to-rear direction of the printer 1. Sheets of the discharged paper 31 are stacked in the discharge holder 64 in the front-to-rear direction.

The top side of the discharge holder 64 is open, enabling a user to retrieve the discharged paper 31 upward through the opening in the top side. Further, by opening the upper cover 11, the discharge holder 64 is exposed, enabling a user to retrieve the stacked paper 31 from the front of the casing 2.

F. Effects of the First Embodiment

In, the printer 1 of the first embodiment described above, prior to image formation the paper 31 is maintained in a vertical orientation within the paper holder 28 of the paper supply unit 3 positioned above and rearward of the process units 33, and more specifically the uppermost black process unit 33K. After image formation, the paper 31 is maintained in a vertical orientation within the discharge holder 64 of the discharge unit 5 positioned above and forward of the process units 33, and more specifically the uppermost black process unit 33K. Hence, the footprint of the printer 1 can be reduced, while the printer 1 is provided with a plurality of the process units 33, regardless of the surface area of the paper 31.

Further, in the printer 1 described above, each of the process units 33 can be mounted into or removed from the casing 2 in a front-to-rear direction by opening the lower cover 12 to expose the process units 33. Hence, the process units 33 can easily be mounted in or removed from the casing 2 without interference from the paper supply unit 3 and discharge unit 5 disposed thereabove.

Further, in the printer 1 described above, while the width of the casing 2 must be sufficiently large to accommodate the width of the paper 31, the dimension of the casing 2 in the direction that the sheets of paper 31 are stacked can be made much narrower than the width direction. Hence, the casing 2 can be formed in a tall, slender shape. However, when the casing 2 is formed with this shape, there is a danger that the casing 2 will tip over if the casing 2 is moved in the front-to-rear direction. Therefore, in the printer 1 of the first embodiment, the casing 2 is supported on the mount 16 having the casters 18 that can only move in the widthwise direction. In this way, the casing 2 can be given mobility, while restricting movement of the casing 2 in the front-to-rear direction to prevent the casing 2 from tipping over. Further, when installing the printer 1 in a narrow space, the printer 1 can be moved smoothly therein. In addition, this construction effectively prevents the printer 1 from moving as the process units 33 are mounted or removed.

In the printer 1 of the first embodiment, the height adjustment mechanism 20 can adjust the height of the casing 2. Hence, by adjusting the height of the casing 2 to correspond to the installation conditions, it is possible to optimize the installation. For example, when the printer 1 is installed to the side of a desk, the height adjustment mechanism 20 can be used to adjust the height of the printer 1 so that the top wall 8 is flush with the height of the desk, thereby improving the interior design and operability.

In the printer 1 of the first embodiment, the discharge holder 64 of the discharge unit 5 is opened when the upper cover 11 is opened, enabling the user to retrieve stacked sheets of pacer 31 from the front side. Further, since the upper cover 11 pivots about the upper shaft 13 extending in the width direction, the upper cover 11 can be more widely opened over the discharge holder 64 than if the upper cover 11 were to pivot about a comparative shaft that extends in the front-to-rear direction.

In the printer 1 of the first embodiment, the process units 33 are exposed when the lower cover 12 is opened, enabling the user to mount or remove the process units 33 individually. Further, since the lower cover 12 pivots about the lower shaft 14 extending in the width direction, the lower cover 12 can be more widely opened over the process units 33 than if the lower cover 12 were to pivot about a comparative shaft that extends in the front-to-rear direction.

In the printer 1 of the first embodiment, the upper cover 11 is disposed above the lower cover 12 so that the upper cover 11 and lower cover 12 can be opened and closed independently without interfering with each other. Hence, the discharge holder 64 of the discharge unit 5 can be exposed or covered by opening and closing the upper cover 11, while the process units 33 can be exposed or covered by independently opening and closing the lower cover 12.

In the printer 1 of the first embodiment, both the upper cover 11 and the lower cover 12 are disposed on the front surface of the casing 2. Accordingly, both the upper cover 11 and lower cover 12 can be opened and closed on the same side of the printer 1, improving operability.

In the printer 1 of the first embodiment, the rear wall 7 on the side opposite the front surface 6 of the casing 2 is flat. Pence, by positioning the printer 1 with the rear wall 7 against a wall, the printer 1 can be disposed against the wall with no gap therebetween, further economizing space.

In the printer 1 of the first embodiment, the control panel 15 is disposed on the top wall a of the casing 2. Hence, the control panel 15 can easily be operated from above when the printer 1 is installed in a narrow space, such as between two desks.

In the printer 1 of the first embodiment, the fixing unit 37 is disposed in the casing 2 above the uppermost black process unit 33K and below the discharge unit 5. With this configuration, the printer 1 can be made more slender, while reducing the effects of heat produced from the fixing unit 37 on the process units 33.

In the printer 1 of the first embodiment, the process units 33 and scanning units 34 are alternately stacked in a vertical direction. Hence, the printer 1 can be made more slender than when the process units 33 and scanning units 34 are juxtaposed in the front-to-rear direction.

In the printer 1 of the first embodiment, the paper supply unit 3 and discharge unit 5 are disposed above the engine unit 4 at positions opposing each other and separated a prescribed distance from each other horizontally. Accordingly, the printer 1 can be made more compact vertically, and the top wall 8 of the casing 2 can be made flat.

In the printer 1 of the first embodiment, the paper 31 is supplied from the paper supply unit 3 onto the conveying path 36, and the paper 31 passes all process units 33 so as to contact the photosensitive drums 39. Subsequently, the paper 31 is discharged into the discharge unit 5. Hence, despite forming a slender printer 1, the paper 31 can be conveyed efficiently to form a full-color image thereon. More specifically, in the transfer belt unit 50 of the transfer unit 35, the conveying belt 54 can convey the paper 31 to sequentially oppose the photosensitive drums 39 of each process unit 33. Hence, the printer 1 can be configured as a direct tandem type device.

Further, the transfer belt unit 50 is disposed so as to oppose the discharge unit 5 vertically. Hence, after the process units 33 have formed a full-color image on the paper 31, the paper 31 can be discharged upward without changing direction. As a result, the paper 31 can be discharged in the discharge unit 5 without a loss in image quality.

Further, each process unit 33 is mounted in or removed from the casing 2 along the curved path P, indicated by a dotted line In FIG. 3. The curved path P passes through the front surface 6 of the casing 2 when the lower cover 12 is open and subsequently arcs vertically upward along the front surface 6 of the casing 2. Therefore, it is only necessary to allocate a slightly wider space than the thickness of the process units 33 (vertical width of the process units 33) for mounting and removing the same, thereby reducing the amount of installation space required for the printer 1 and consequently improving the freedom of choice for mounting the printer 1.

The upper and lower covers 11 and 12 may be integrated together into a single cover.

Second Embodiment

Next will be described a color laser printer 101 according to a second embodiment of the invention with reference to FIGS. 5 and 6.

Figure 5:
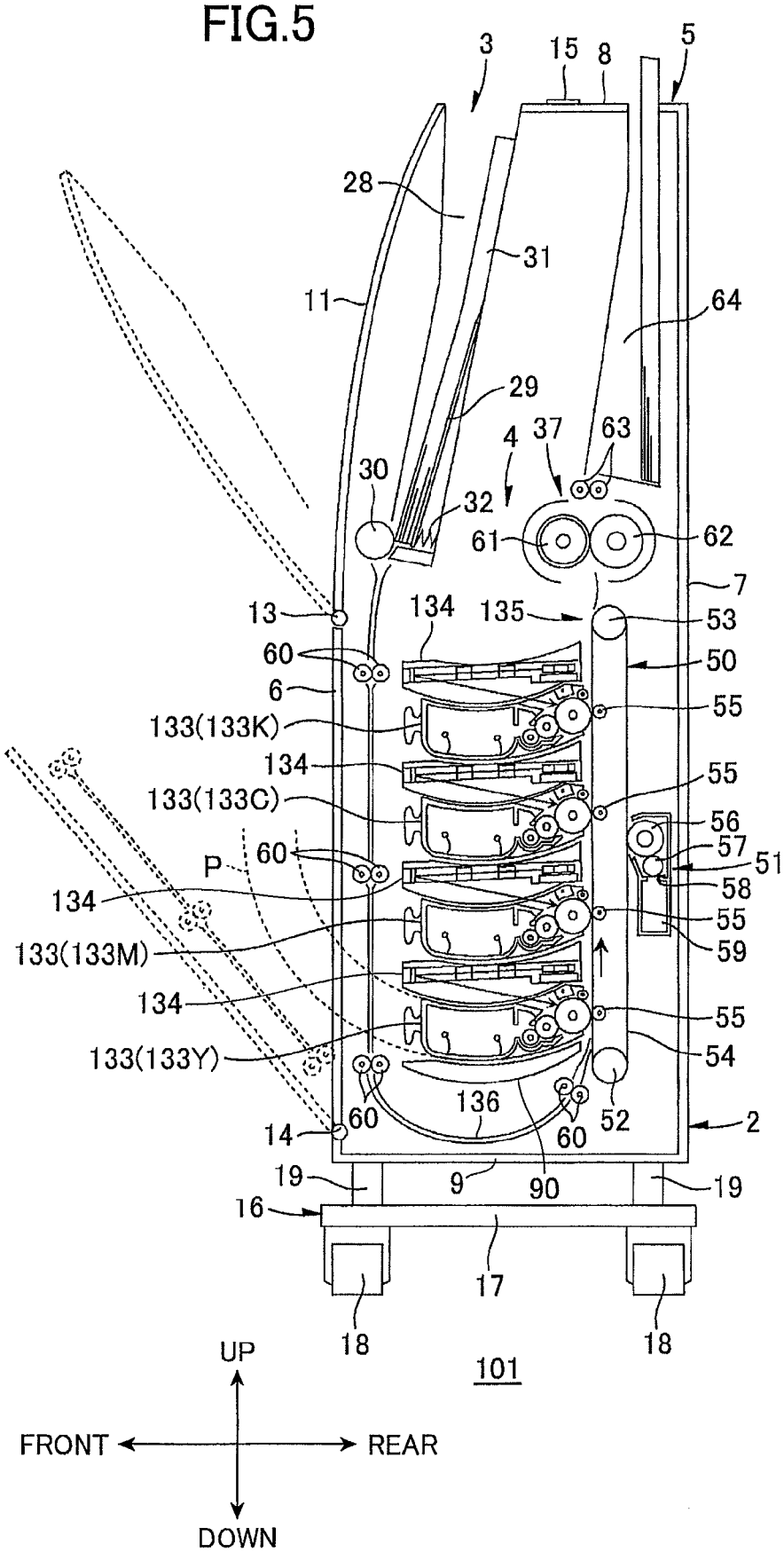
FIG. 5 is a side cross-sectional view of a color laser printer according to a second embodiment of the invention.

FIG. 5 is a side cross-sectional view of the color laser printer 101. FIG. 6 is an enlarged side cross-sectional view of a process unit 133 and scanning unit 134 shown in FIG. 5.

Below, only configurations of the second embodiment that differ from the first embodiment will be described, while the construction similar to the first embodiment is omitted. Further, like parts and components to those in the first embodiment are designated with the same reference numerals.

The color laser printer 101 of the present embodiment is the same as the color laser printer 1 of the first embodiment except that the positions of the paper supply unit 3 and discharge unit 5 in the front-to-rear direction are reversed to that in the first embodiment, and that the engine unit 4 of the present embodiment has a plurality of the process units 133, a plurality of the scanning units 134, a transfer unit 135, and a conveying path 136 in place of the plurality of process units 33, the plurality of scanning units 34, the transfer unit 35, and the conveying path 36 in the first embodiment.

A. General Structure of a Color Laser Printer

As in the first embodiment described above, the printer 101 in FIG. 5 is configured of a vertical direct tandem color laser printer. However, in the second embodiment, the positions of the paper supply unit 3 and discharge unit 5 in the front-to-rear direction are reversed to that in the first embodiment.

B. Casing

As in the first embodiment described above, the upper cover 11 and lower cover 12 are provided on the front surface 6 of the casing 2. The upper cover 11 exposes and covers the paper supply unit 3, and the lower cover 12 exposes and covers the engine unit 4. The front section of the conveying path 136 described later is fixed to the lower cover 12 in the second embodiment. Hence, the front section of the conveying path 136 moves together with the lower cover 12 when the lower cover 12 is opened and closed.

C. Paper Supply Unit

The paper supply unit 3 is disposed in the front side of the casing 2 above the process units 133 in the engine unit 4. The paper supply unit 3 includes the paper holder 28, the paper-pressing plate 29, and the feeding roller 30 similarly to the first embodiment.

The paper holder 28 is formed in the casing 2 as a recessed part for accommodating the paper 31. The paper holder 28 is shaped substantially rectangular from a front view, and the front side of the paper holder 28 is opened or covered by the upper cover 11. The top of the paper holder 28 is open, enabling the user to insert the paper 31 through the opening to load the paper 31 on the paper-pressing plate 29. When the upper cover 11 is opened, the paper holder 28 is exposed through the open upper cover 11, enabling the user to load the paper 31 through the front of the casing 2.

The paper 31 is maintained substantially in a vertical orientation in the paper holder 28 on the front side of the paper-pressing plate 29 and is stacked in a front-to-rear direction opposing the urging force of the compressed spring 32. The forwardmost sheet of the paper 31 stacked on the front side of the paper-pressing plate 29 is pressed against the feeding roller 30 by the urging force of the compressed spring 32. The feeding roller 30 rotates to feed the paper 31 toward the engine unit 4 one sheet at a time.

D. Engine Unit

The engine unit 4 of the present embodiment includes the plurality of process units 133, the plurality of scanning units 134, the transfer unit 135, the conveying path 136, and the fixing unit 37. Thus, the engine unit 4 of the present embodiment has the process units 133, scanning units 134, transfer unit 135, and conveying path 136 in place of the process units 33, scanning units 34, transfer unit 35, and conveying path 36 in the first embodiment.

a. Process Units

Similarly to the first embodiment, four of the process units 133 are provided in the casing 2 for each of four different colors. The process units 133 are positioned below the paper supply unit 3 and discharge unit 5 and are detachably mounted in the casing 2.

By opening the lower cover 12 to the position indicated by the dotted line, each process unit 133 can be independently mounted in or removed from the casing 2 in the front-to-rear direction. The mounted process units 133 are covered when the lower cover 12 is closed in the position indicated by the solid line.

Figure 6:
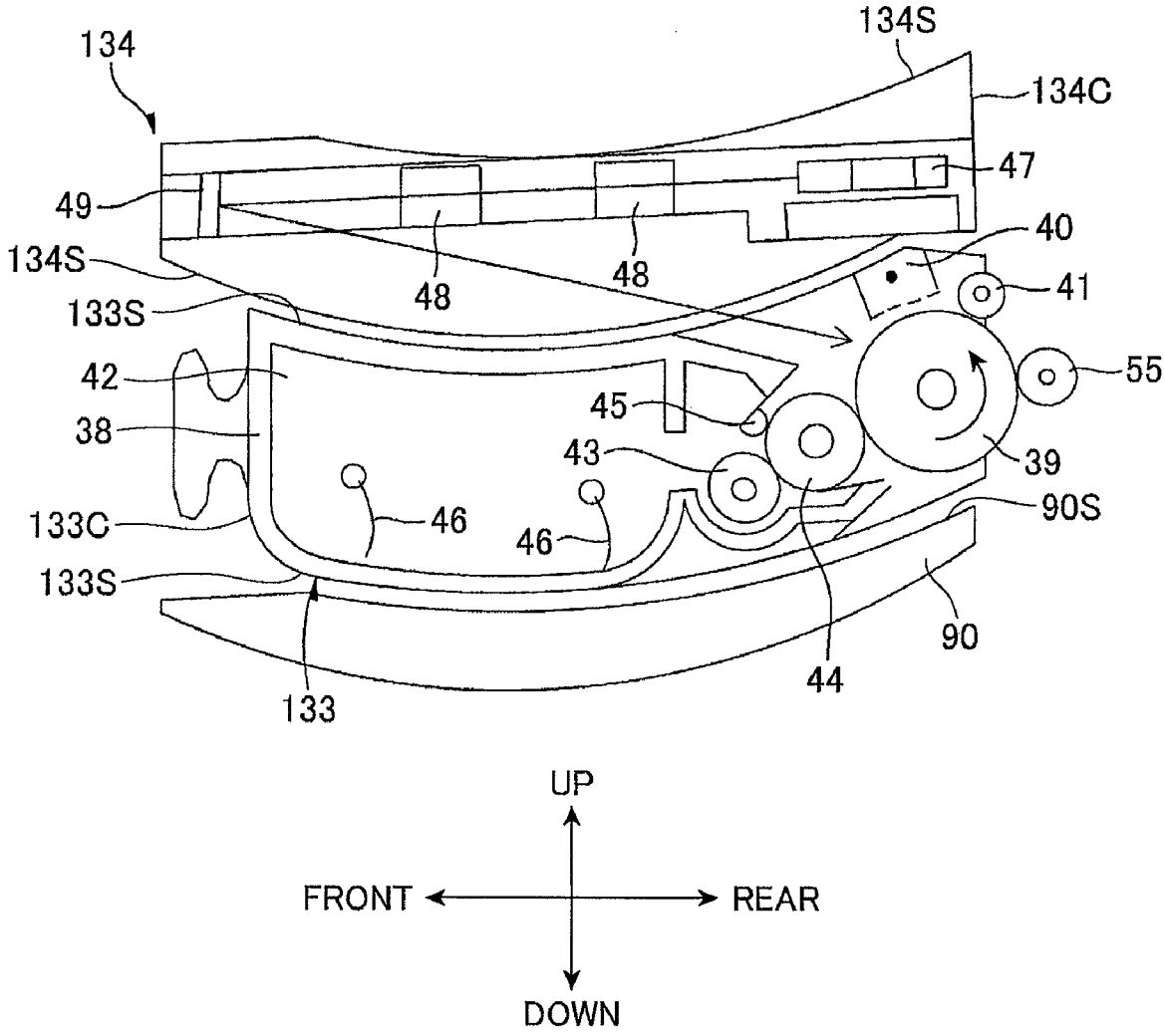
FIG. 6 is an enlarged side cross-sectional view of a process unit and scanning unit shown in FIG. 5.

As shown in FIG. 6, similarly to the process unit 33 of the first embodiment, each process unit 133 includes a casing 133*c* with a pair of opposite arcing surfaces 133*s*. Each process unit 133 includes, within the casing 133*c*, the developer cartridge 38, photosensitive drum 39, Scorotron charger 40, and drum cleaning roller 41. These components 38, 39, 40, and 41 are disposed on the opposite side in the front-to-rear direction from the side disposed in the process unit 33 of the first embodiment.

Specifically, the developer cartridge 38 is located in the front section of the casing 133*c*, and the toner-accommodating section 42 is an internal space formed in the front side of the developer cartridge 38. The agitators 46 disposed in the toner-accommodating section 42 rotate to agitate toner accommodated therein. Through the agitation of the agitators 46, some of the toner is discharged toward the supply roller 43 through a toner supply opening that is formed in the rear side of the toner-accommodating section 42.

The supply roller 43 is rotatably disposed to the rear of the toner supply opening. The developing roller 44 is rotatably disposed to the rear of the supply roller 43 and in confrontation with the same. Further, the developing roller 44 is positioned so that a rear portion thereof is exposed through an opening formed in the rear side of the developer cartridge 38.

The thickness-regulating blade 45 is disposed near the top of the developing roller 44 so that the pressing part contacts the surface of the developing roller 44 with pressure.

Toner discharged through the toner supply opening is supplied onto the developing roller 44 by the rotating supply roller 43. At this time, the toner is positively tribocharged between the supply roller 43 and the developing roller 44. As the developing roller 44 rotates, toner carried on the surface of the developing roller 44 passes beneath the pressing part of the thickness-regulating blade 45 so that a thin layer of uniform thickness is carried on the developing roller 44.

The photosensitive drum 39 is disposed on the rear side of the developing roller 44 and is capable of rotating in the process unit 133 while in contact with the developing roller 44. Further, the photosensitive drum 39 is positioned so that a rear portion of the photosensitive drum 39 is exposed through an opening formed in the rear side of the process unit 133.

The charger 40 is disposed above the photosensitive drum 39 with a prescribed amount of separation so as not to contact the photosensitive drum 39.

The drum cleaning roller 41 is rotatably disposed in the process unit 133 so as to contact the photosensitive drum 39 at a position upstream of the charger 40 with respect to the rotational direction of the photosensitive drum 39.

A toner image of each color is formed on the photosensitive drum 39 in each process unit 133 through the same process described in the first embodiment.

b. Scanning Unit

As shown in FIG. 5, the scanning units 134 are disposed in the casing 2 below the paper supply unit 3 and discharge unit 5. Four of the scanning units 134 are fixed to the casing 2 at positions corresponding to the process units 133 provided for each color. The scanning units 134 are arranged to be stacked vertically at prescribed intervals so that each scanning unit 134 is disposed above the corresponding process unit 133. Hence, the process units 133 and scanning units 134 are alternately stacked in the vertical direction within the casing 2.

As shown in FIG. 6, similarly to the scanning unit 34 of the first embodiment, each scanning unit 134 has a casing 134*c* with upper and lower guiding surfaces 134*s*. Each scanning unit 134 includes, within the casing 134*c*, the laser light-emitting unit (not shown), polygon mirror 47, two lenses 48, and reflecting mirror 49. In the scanning unit 134, similarly to the first embodiment, the laser light-emitting unit (not shown) emits a laser beam based on prescribed image data. As indicated by the arrow in FIG. 6, the laser beam sequentially passes through or is reflected by the polygon mirror 47, the two lenses 48, and the reflecting mirror 49 and is subsequently irradiated in a high-speed scan onto the surface of the respective photosensitive drum 39, as described above.

Similarly to the first embodiment, the guiding member 90 having the upper guiding surface 90*s* is provided in the casing 2. Similarly to the first embodiment, the upper and lower guiding surfaces 134*s* of the casing 134*c* in each scanning unit 134 and the upper guiding surface 90*s* of the guiding member 90 follow the curved path P. The pair of opposite arcing surfaces 133*s* of the casing 133*c* in each process unit 133 can follow the curved path P. Thus, similarly to the first embodiment, when mounting or removing each process unit 133, the process unit 133 is guided by an upper scanning unit 134 and by a lower member (scanning unit 134 or guiding member 90) along the curved path P.

c. Transfer Unit

As shown in FIG. 5, the transfer unit 135 is provided in the casing 2 between the process units 133 and the rear wall 7. The transfer unit 135 is oriented vertically so as to oppose each of the process units 133 stacked vertically in the casing 2. The transfer unit 135 includes the transfer belt unit 50, and the belt cleaner unit 51.

The transfer belt unit 50 extends vertically so as to oppose each of the photosensitive drums 39, which are arranged to be stacked vertically.

In this transfer belt unit 50, when the drive roller 53 is driven to rotate, the follow roller 52 follows this rotation as the conveying belt 54 circulates around the drive roller 53 and follow roller 52 so that the outer surface of the conveying belt 54 on the front side contacting the photosensitive drums 39 moves in the same direction as the surfaces of the photosensitive drums 39 at the contact points.

The transfer rollers 55 are disposed inside the conveying belt 54 at positions opposing the photosensitive drums 39 so as to pinch the conveying belt 54 therebetween.

The belt cleaner unit 51 has the same construction as that described in the first embodiment and is disposed on the opposite side (rear side) of the conveying belt 54 from the photosensitive drums 39. The belt cleaner unit 51 is positioned between the drive roller 53 and follow roller 52 vertically so that the cleaning roller 56 contacts the outer surface of the conveying belt 54 in the rear section.

d. Conveying Path

The conveying path 136 is formed from the lower end of the paper supply unit 3 to the lower front corner of the process units 133 in the front section of the casing 2. From this point, the conveying path 136 describes a U-shaped path that passes beneath and around the lowermost yellow process unit 133Y. Now in the rear section of the casing 2, the conveying path 136 continues upward between the conveying belt 54 and the photosensitive drums 39 of the process units 133. The paper 31 is conveyed along this conveying path 136.

A plurality of the conveying rollers 60 are provided along the conveying path 136 in the front and lower sections of the casing 2 for conveying the paper 31 through these front and lower sections of the conveying path 136. In the rear section of the conveying path 136, the conveying belt 54 conveys the paper 31.

As described above, the front section of the conveying path 136 is integrally supported on the lower cover 12. Accordingly, when the lower cover 12 is opened, the front section of the conveying path 136 moves together with the lower cover 12 and separates from the process units 133, as illustrated by the dotted line. When the lower cover 12 is closed, the front section of the conveying path 136 moves together with the lower cover 12 into a position in proximity of the process units 133, as indicated by the solid line.

e. Fixing Unit

The fixing unit 37 is disposed in the casing 2 above the uppermost black process unit 133K and the transfer unit 135 and below the discharge unit 5. As in the first embodiment, the fixing unit 37 includes the heating roller 61 and the pressure roller 62.

f. Image Formation in the Engine Unit

With the above construction, the paper supply unit 3 feeds the paper 31 onto the conveying path 136, and the conveying rollers 60 provided in the front and lower sections of the conveying path 136 convey the paper 31 downward in the front section and along the U-shaped curve around the lowermost yellow process unit 133Y. Subsequently, the conveying belt 54 receives and conveys the paper 31 upward in the rear section of the conveying path 136.

Specifically, the driving of the drive roller 53 moves the conveying belt 54 circularly as the follow roller 52 follows, and the conveying belt 54 conveys the paper 31 through the rear section of the conveying path. The paper 31 is sequentially conveyed between the conveying belt 54 and the photosensitive drum 39 of each process unit 133 at transfer positions therebetween. As in the first embodiment, as the paper 31 passes through these transfer positions, toner images in each color formed on the respective photosensitive drum 39 are sequentially transferred onto the paper 31, forming a full-color image on the paper 31.

After a full-color image has been formed on the paper 31, the image is fixed to the paper 31 in the fixing unit 37, and the paper 31 is conveyed to the discharge unit 5.

E. Discharge Unit

The discharge unit 5 is disposed in the casing 2 above and rearward of the process units 133 in the engine unit 4. The discharge unit 5 also opposes and is separated a prescribed distance from the paper supply unit 3 horizontally in the front-to-rear direction and opposes the transfer unit 135 of the engine unit 4 vertically. The discharge unit 5 includes the discharge rollers 63 and the discharge holder 64, similarly to the first embodiment.

The discharge rollers 63 are disposed above the fixing unit 37 and below the discharge holder 64. After a full-color image has been fixed by heat to the paper 31 in the fixing unit 37, the discharge rollers 63 discharge the paper 31 into the discharge holder 64.

The discharge holder 64 is provided in the casing 2 as a recessed part formed substantially in the shape of a rectangle when viewed from the front side and is capable of accommodating sheets of the paper 31. The top side of the discharge holder 64 is open, and the vertical depth of the discharge holder 64 is set so that the discharges paper 31 is exposed through the open top side of the discharge holder 64. Hence, when the discharge rollers 63 discharge the paper 31, the paper 31 is maintained substantially vertically inside the discharge holder 64 so that the top edge of the paper 31 protrudes from the casing 2. Sheets of the discharged paper 31 are therefore stacked In a front-to-rear direction in the discharge holder 64.

F. Effects of the Second Embodiment

In the printer 101 of the second embodiment described above, prior to image formation the paper 31 is maintained substantially in a vertical orientation within the paper holder 28 of the paper supply unit 3 positioned above and forward of the process units 133, and more specifically the uppermost black process unit 133K. After image formation, the paper 31 is maintained substantially in a vertical orientation within the discharge holder 64 of the discharge unit 5 positioned above and rearward of the process units 133, and more specifically the uppermost black process unit 133K. Hence, as in the printer 1 according to the first embodiment, the footprint of the printer 101 can be reduced, while the printer 101 is provided with a plurality of the process units 133, regardless of the surface area of the paper 31.

Further, in the printer 101 described above, each of the process units 133 can be mounted into or removed from the casing 2 in a front-to-rear direction by opening the lower cover 12 to expose the process units 133. Hence, the process units 133 can easily be mounted in or removed from the casing 2 without interference from the paper supply unit 3 and discharge unit 5 disposed thereabove.

Further, in the printer 101 described above, the paper holder 28 is opened by opening the upper cover 11, enabling the paper 31 to be stacked in the paper holder 28 on the paper-pressing plate 29. Further, since the upper cover 11 pivots about the upper shaft 13 extending in the width direction, the upper cover 11 can be more widely opened over the paper holder 28 of the paper supply unit 3 than if the upper cover 11 were to pivot about a comparative shaft that extends in the front-to-rear direction.

In the printer 101 of the second embodiment, the process units 133 are exposed when the lower cover 12 is opened, enabling the user to mount or remove the process units 133 individually. Further, since the lower cover 12 pivots about the lower shaft 14 extending in the width direction, the lower cover 12 can be more widely opened over the process units 133 than if the lower cover 12 were to pivot about a comparative shaft that extends in the front-to-rear direction.

In the printer 101 of the second embodiment, the upper cover 11 is disposed above the lower cover 12 so that the upper cover 11 and lower cover 12 can be opened and closed independently without interfering with each other. Hence, the paper holder 28 of the paper supply unit 3 can be exposed or covered by opening and closing the upper cover 11, while the process units 133 can be exposed or covered by independently opening and closing the lower cover 12.

Third Embodiment

Next will be described a color laser printer 201 according to a third embodiment of the invention with reference to FIGS. 7 and 8.

Figure 7:
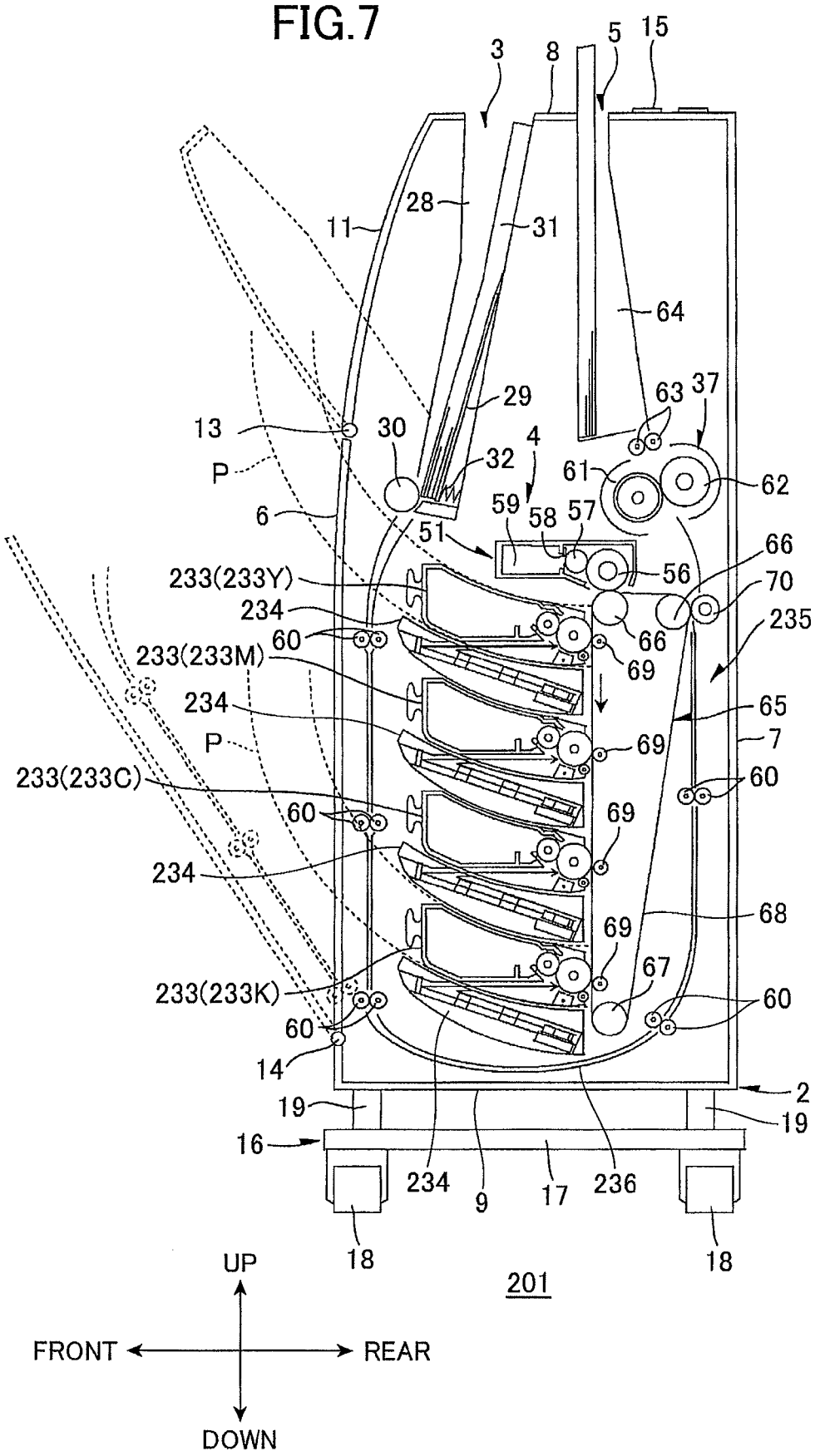
FIG. 7 is a side cross-sectional view of a color laser printer according to a third embodiment of the invention.

FIG. 7 is a side cross-sectional view of the color laser printer 201. FIG. 8 is an enlarged side cross-sectional view of a process unit 233 and scanning unit 234 shown in FIG. 7. Below, only configurations of the third embodiment that differ from the first embodiment will be described, while the construction similar to the first embodiment is omitted. Further, like parts and components to those in the first embodiment are designated with the same reference numerals.

The color laser printer 201 of the present embodiment is the same as the color laser printer 1 of the first embodiment except that the printer 201 is of an intermediate transfer tandem type, that the positions of the paper supply unit 3 and discharge unit 5 in the front-to-rear direction are reversed to that in the first embodiment, and that the engine unit 4 of the present embodiment has a plurality of the process units 233, a plurality of the scanning units 234, a transfer unit 235, and a conveying path 236 in place of the plurality of process units 33, the plurality of scanning units 34, the transfer unit 35, and the conveying path 36 in the first embodiment.

A. General Structure of a Color Laser Printer

Unlike the first embodiment described above, the printer 201 of the present embodiment is configured of an intermediate transfer tandem color laser printer. Further, in the present embodiment, the positions of the paper supply unit 3 and discharge unit 5 in the front-to-rear direction are reversed to that in the first embodiment.

B. Casing

As in the first embodiment described above, the casing 2 includes the upper cover 11 and lower cover 12. The upper cover 11 exposes and covers the sheet supplying unit 3, and the lower cover 12 exposes and covers the engine unit 4. The front section of the conveying path 236 described later is fixed to the lower cover 12 in the third embodiment. Hence, the front section of the conveying path 236 moves together with the lower cover 12 when the lower cover 12 is opened and closed.

C. Paper Supply Unit

The taper supply unit 3 is disposed in the front side of the casing 2 above the process units 233 in the engine unit 4. Similarly to the first embodiment, the paper supply unit 3 includes the paper holder 28, paper-pressing plate 29, and feeding roller 30.

The paper holder 28 is formed in the casing 2 as a recessed part for accommodating the pacer 31. The paper holder 28 is shaped substantially rectangular from a front view, and the front side of the paper holder 28 is opened or covered by the upper cover 11. The top of the paper holder 28 is open, enabling the user to insert the paper 31 through the opening to load the paper 31 on the paper-pressing plate 29. When the upper cover 11 is opened, the paper holder 28 is exposed through the open upper cover 11, enabling the user to load the paper 31 through the front of the casing 2.

The paper 31 is maintained substantially in a vertical orientation in the paper holder 28 on the front side of the paper-pressing plate 29 and is stacked in a front-to-rear direction opposing the urging force of the compressed spring 32. The forwardmost sheet of the paper 31 stacked on the front side of the paper-pressing plate 29 is pressed against the feeding roller 30 by the urging force of the compressed spring 32. The feeding roller 30 rotates to feed the paper 31 toward the engine unit 4 one sheet at a time.

D. Engine Unit

The engine unit 4 of the present embodiment includes the plurality of process units 233, plurality of scanning units 234, transfer unit 235, conveying path 236, and the fixing unit 37. Thus, the engine unit 4 of the present embodiment has the process units 233, scanning units 234, transfer unit 235, and conveying path 236 in place of the process units 33, scanning units 34, transfer unit 35, and conveying path 36 in the first embodiment.

a. Process Units

Similarly to the first embodiment, in the third embodiment, four of the process units 233 are provided in the casing 2 for each of four different colors. The process units 233 are positioned below the paper supply unit 3 and discharge unit 5 and are detachably mounted in the casing 2. More specifically, the process units 233 include a yellow process unit 233Y, magenta process unit 233M, cyan process unit 233C, and black process unit 233K. These process units 233 are vertically stacked in the casing 2 from top to bottom in the order given and are separated from each other by a prescribed distance.

By opening the lower cover 12 to the position indicated by the dotted line, each process unit 233 can be independently mounted in or removed from the casing 2 in the front-to-rear direction. The mounted process units 233 are covered when the lower cover 12 is closed in the position indicated by the solid line.

Figure 8:
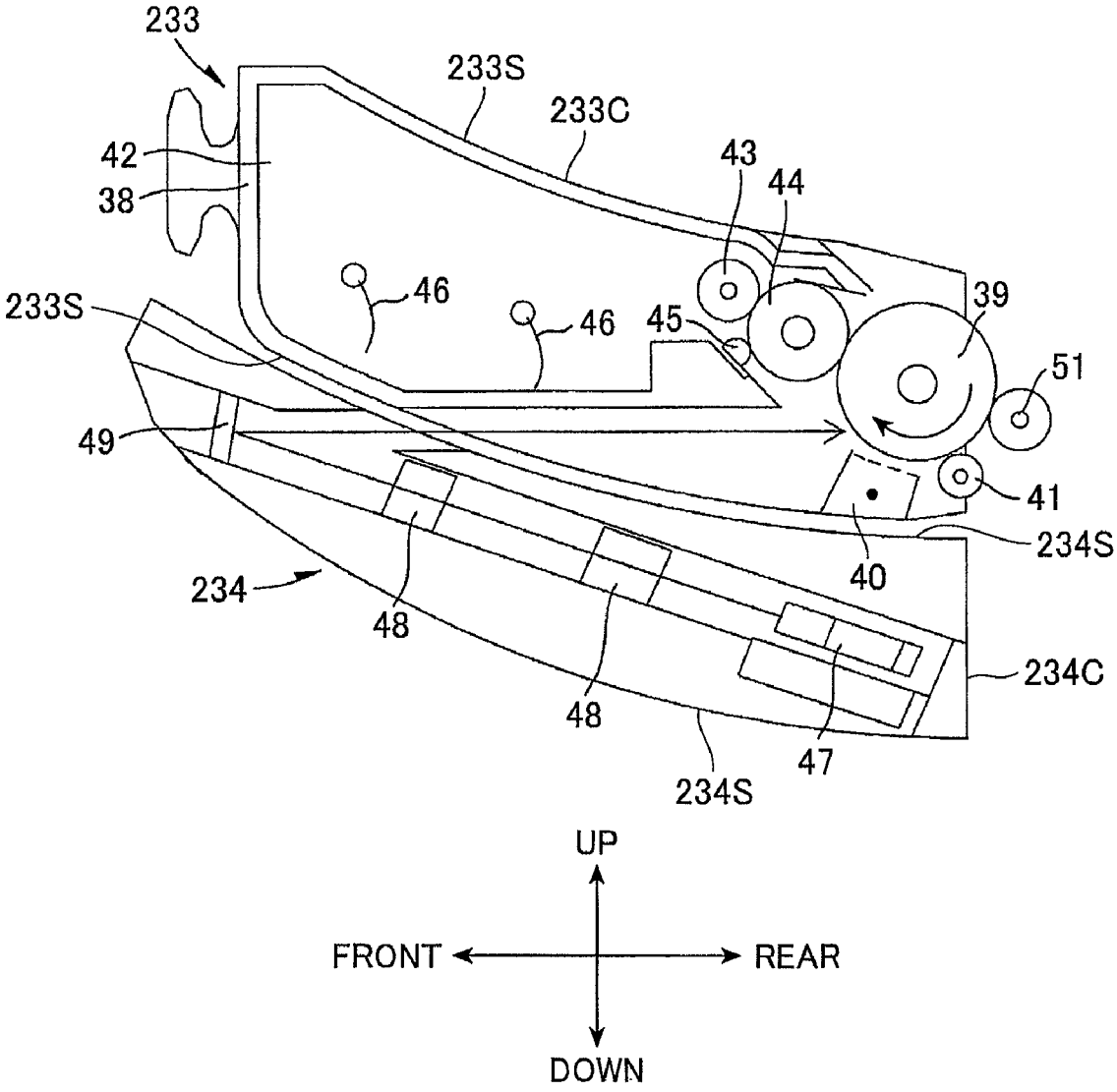
FIG. 8 is an enlarged side cross-sectional view of a process unit and scanning unit shown in FIG. 7.

As shown in FIG. 8, similarly to the first embodiment, each process unit 233 includes a casing 233*c* with a pair of opposite arcing surfaces 233*s*. Each process unit 233 includes, within the casing 233*c*, the developer cartridge 38, the photosensitive drum 39, the Scorotron charger 40, and the drum cleaning roller 41. These components 38, 39, 40, and 41 are disposed on the opposite side in the front-to-rear direction and in an opposite vertical order from the side described in the first embodiment.

Specifically, the developer cartridge 38 is located in the front section of the casing 233*c*, and the toner-accommodating section 42 is an internal space formed in the front side of the developer cartridge 38. The agitators 46 disposed in the toner-accommodating section 42 rotate to agitate toner accommodated therein. Through the agitation of the agitators 46, some of the toner is discharged toward the supply roller 43 through a toner supply opening formed in the rear side of the toner-accommodating section 42.

The supply roller 43 is rotatably disposed to the rear of the toner supply opening. The developing roller 44 is rotatably disposed to the rear of the supply roller 43 and in confrontation with the same. Further, the developing roller 44 is positioned so that a rear portion thereof is exposed through an opening formed in the rear side of the developer cartridge 38.

The thickness-regulating blade 45 is disposed near the bottom of the developing roller 44 so that the pressing part contacts the surface of the developing roller 44 with pressure.

Toner discharged through the toner supply opening is supplied onto the developing roller 44 by the rotating supply roller 43. At this time, the toner is positively tribocharged between the supply roller 43 and the developing roller 44. As the developing roller 44 rotates, toner carried on the surface of the developing roller 44 passes above the pressing part of the thickness-regulating blade 45 so that a thin layer of uniform thickness is carried on the developing roller 44.

The photosensitive drum 39 is disposed on the rear side of the developing roller 44 and is capable of rotating in the process unit 233 while in contact with the developing roller 44. Further, the photosensitive drum 39 is positioned so that a rear portion of the photosensitive drum 39 is exposed through an opening formed in the rear side of the process unit 233.

The charger 40 is disposed below the photosensitive drum 39 with a prescribed amount of separation so as not to contact the photosensitive drum 39.

The drum cleaning roller 41 is rotatably disposed in the process unit 233 so as to contact the photosensitive drum 39 at a position upstream of the charger 40 with respect to the rotational direction of the photosensitive drum 39.

A toner image of each color is formed on the photosensitive drum 39 in each process unit 233 through the same process described in the first embodiment.

b. Scanning Unit

As shown in FIG. 7, the scanning units 234 are disposed in the casing 2 below the paper supply unit 3 and discharge unit 5. Four of the scanning units 234 are fixed to the casing 2 at positions corresponding to the process units 233 provided for each color. The scanning units 234 are arranged to be stacked vertically at prescribed intervals so that each scanning unit 234 is disposed below the corresponding process unit 233. Hence, the process units 233 and scanning units 234 are alternately stacked in the vertical direction within the casing 2.

As shown in FIG. 8, similarly to the scanning unit 34 of the first embodiment, each scanning unit 234 has a casing 234*c* with upper and lower guiding surfaces 234*s*. Each scanning unit 234 includes, within the casing 234*c*, the laser light-emitting unit (not shown), polygon mirror 47, two lenses 48, and reflecting mirror 49. In the scanning unit 234, similarly to the first embodiment, the laser light-emitting unit (not shown) emits a laser beam based on prescribed image data. As indicated by the arrow in FIG. 8, the laser beam sequentially passes through or is reflected by the polygon mirror 47, the two lenses 48, and the reflecting mirror 49 and is subsequently irradiated in a high-speed scan onto the surface of the respective photosensitive drum 39, as described above.

Unlike the first embodiment, the guiding member 90 is not provided in the casing 2. Similarly to the first embodiment, the upper and lower guiding surfaces 234*s* of the casing 234*c* in each scanning unit 234 follow the curved path P. The pair of opposite arcing surfaces 233*s* of the casing 233*c* in each process unit 233 can follow the curved path P. Thus, similarly to the first embodiment, when mounting or removing each process unit 233, the process unit 233 is guided by its neighboring scanning unit 234 along the curved path P.

c. Transfer Unit

As shown in FIG. 7, the transfer unit 235 is provided in the casing 2 between the process units 233 and the rear wall 7. The transfer unit 235 is oriented vertically so as to oppose each of the process units 233 stacked vertically in the casing 2. The transfer unit 235 includes an intermediate transfer unit 65 and the belt cleaner unit 51.

The intermediate transfer unit 65 extends vertically so as to oppose each of the photosensitive drums 39, which are arranged to be stacked vertically. The intermediate transfer unit 65 includes a drive roller 67, two follow rollers 66, a conveying belt 68, primary transfer rollers 69, and a secondary transfer roller 70.

The drive roller 67 is disposed lower than the photosensitive drum 39 of the bottommost black process unit 233K. One of the follow rollers 66 is disposed higher than the photosensitive drum 39 of the topmost yellow process unit 233Y. The other follow roller 66 is disposed rearward of the first follow roller 66. Hence, the drive roller 67 and the two follow rollers 66 form a triangle in a side view.

The conveying belt 68 is formed of an electrically conductive polycarbonate, polyimide, or the like diffused with electrically conductive carbon particles or the like. The conveying belt 68 is looped around the drive roller 67 and follow rollers 66 so that the outer surface of the conveying belt 68 on the forward facing side contacts all of the photosensitive drums 39 in the process units 233.

When the drive roller 67 is driven to rotate, the follow rollers 66 follow this rotation as the conveying belt 68 circulates around the drive roller 67 and follow rollers 66 so that the outer surface of the conveying belt 54 on the front side contacting the photosensitive drums 39 moves in the same direction as the surfaces of the photosensitive drums 39 at the contact points.

The primary transfer rollers 69 are disposed inside the conveying belt 68 at positions opposing the photosensitive drums 39 so as to pinch the conveying belt 68 therebetween. Each primary transfer roller 69 is configured of a metal roller shaft that is covered with an electrically conductive rubber roller. The primary transfer rollers 69 are disposed in contact with the inner surface of the conveying belt 68 on the front side and rotate in a direction conforming to the circular movement of the conveying belt 68. During a transfer operation, a power supply (not shown) applies a primary transfer bias to the primary transfer rollers 69.

The secondary transfer roller 70 is disposed outside the conveying belt 68 at a position opposing the rearmost follow roller 66 so as to pinch the conveying belt 68 therebetween. The secondary transfer roller 70 is configured of a metal roller shaft that is covered with an electrically conductive rubber roller. The secondary transfer roller 70 is disposed in contact with the outer surface of the conveying belt 68 on the rear side and rotates in a direction conforming to the circular movement of the conveying belt 68. During a transfer operation, a power supply (not shown) applies a secondary transfer bias to the secondary transfer roller 70.

The belt cleaner unit 51 is disposed on the outer side of the conveying belt 68 and has a similar construction to that in the first embodiment. The cleaning roller 56 of the belt cleaner unit 51 is positioned so as to confront the foremost follow roller 66 with the conveying belt 68 interposed therebetween.

d. Conveying Path

The conveying path 236 is formed from the lower end of the paper supply unit 3 to the lower front corner of the process units 233 in the front section of the casing 2. From this point, the conveying path 236 describes a U-shaped path that sasses beneath and around the lowermost black process unit 233K. Now in the rear section of the casing 2, the conveying path 236 continues upward around the rear side of the conveying belt 68. The paper 31 is conveyed along this conveying path 236.

A plurality of the conveying rollers 60 is provided along the conveying path 236 in the front, lower, and rear sections of the casing 2 for conveying the paper 31.

As described above, the front section of the conveying path 236 is integrally supported on the lower cover 12. Accordingly, when the lower cover 12 is opened, the front section of the conveying path 236 moves together with the lower cover 12 and separates from the process units 233, as illustrated by the dotted line. When the lower cover 12 is closed, the front section of the conveying path 236 moves together with the lower cover 12 into a position in proximity of the process units 233, as indicated by the solid line.

e. Fixing Unit

The fixing unit 37 is disposed in the casing 2 above the uppermost yellow process unit 233Y and the secondary transfer roller 70 and below the discharge unit 5. As in the first embodiment, the fixing unit 37 includes the heating roller 61 and the pressure roller 62.

f. Image Formation in the Engine Unit

With the above construction, the paper supply unit 3 feeds the paper 31 onto the conveying path 236, and the conveying rollers 60 convey the paper 31 downward in the front section and along the U-shaped curve around the black process unit 233K. Subsequently, the conveying rollers 60 convey the paper 31 upward in the rear section of the conveying path 236.

In the meantime in the transfer unit 235, the drive roller 67 is driven, and the conveying belt 68 moves in a circular path as the follow rollers 66 follow. Toner images in each color formed on each photosensitive drum 39 are sequentially transferred onto the conveying belt 68, forming a full-color image thereon. The full-color image formed on the conveying belt 68 is subsequently transferred altogether onto the paper 31 as the paper 31 passes between the rearmost follow roller 66 and the secondary transfer roller 70.

After a full-color image has been formed on the paper 31, the image is fixed to the paper 31 in the fixing unit 37, and the paper 31 is conveyed to the discharge unit 5.

E. Discharge Unit

The discharge unit 5 is disposed in the casing 2 above and rearward of the process units 233 in the engine unit 4. The discharge unit 5 also opposes and is separated a prescribed distance from the paper supply unit 3 horizontally in the front-to-rear direction and opposes the transfer unit 235 of the engine unit 4 vertically. The discharge unit 5 includes the discharge rollers 63 and the discharge holder 64.

The discharge rollers 63 are disposed above the fixing unit 37 and below the discharge holder 64. After a full-color image has been fixed by heat to the paper 31 in the fixing unit 37, the paper 31 is discharged into the discharge holder 64.

The discharge holder 64 is provided in the casing 2 as a recessed part formed substantially in the shape of a rectangle when viewed from the front side and is capable of accommodating sheets of the paper 31. The top side of the discharge holder 64 is open, and the vertical depth of the discharge holder 64 is set so that the discharged paper 31 is exposed through the open top side of the discharge holder 64. Hence, when the discharge rollers 63 discharges the paper 31, the paper 31 is maintained substantially vertically inside the discharge holder 64 so that the top edge of the paper 31 protrudes from the casing 2. Sheets of the discharged paper 31 are therefore stacked in a front-to-rear direction in the discharge holder 64.

F. Effects of the Third Embodiment

In the printer 201 of the third embodiment described above, prior to image formation the paper 31 is maintained substantially in a vertical orientation within the paper holder 28 of the paper supply unit 3 positioned above and forward of the process units 233, and more specifically the uppermost yellow process unit 233Y. After image formation, the paper 31 is maintained substantially in a vertical orientation within the discharge holder 64 of the discharge unit 5 positioned above and rearward of the process units 233, and more specifically the uppermost yellow process unit 233Y. Hence, as in the printer 1 according to the first embodiment, the footprint of the printer 201 can be reduced, while the printer 201 is provided with a plurality of the process units 233, regardless of the surface area of the paper 31.

Further, in the printer 201 described above, each of the process units 233 can be mounted into or removed from the casing 2 in a front-to-rear direction by opening the lower cover 12 to expose the process units 233. Hence, the process units 233 can easily be mounted in or removed from the casing 2 without interference from the paper supply unit 3 and discharge unit 5 disposed thereabove.

Further, in the printer 201 described above, the paper holder 28 is opened by opening the upper cover 11, enabling the paper 31 to be stacked in the paper holder 28 on the paper-pressing plate 29. Further, since the upper cover 11 pivots about the upper shaft 13 extending in the width direct ion, the upper cover 11 can be more widely opened over the paper holder 28 of the paper supply unit 3 than if the upper cover 11 were to pivot about a comparative shaft that extends in the front-to-rear direction.

In the printer 201 of the third embodiment, the process units 233 are exposed when the lower cover 12 is opened, enabling the user to mount or remove the process units 233 individually. Further, since the lower cover 12 pivots about the lower shaft 14 extending in the width direction, the lower cover 12 can be more widely opened over the process units 233 than if the lower cover 12 were to pivot about a comparative shaft that extends in the front-to-rear direction.

In the printer 201 of the third embodiment, the upper cover 11 is disposed above the lower cover 12 so that the upper cover 11 and lower cover 12 can be opened and closed independently without Interfering with each other. Hence, the paper holder 28 of the paper supply unit 3 can be exposed or covered by opening and closing the upper cover 11, while the process units 233 can be exposed or covered by independently opening and closing the lower cover 12.

In the printer 201 according to the third embodiment, a primary transfer is performed with the intermediate transfer unit 65 to superpose color toner images from each photosensitive drum 39 on the conveying belt 68. Subsequently, a secondary transfer is performed to transfer the superposed color toner images (full-color image) onto the paper 31. Hence, this construction achieves an intermediate transfer tandem device.

Further, the intermediate transfer unit 65 is disposed in opposition to the discharge unit 5 vertically. Therefore, after a full-color image is formed on the paper 31 by the process units 233, the paper 31 can be discharged upward along the same direction. As a result, the paper 31 can be discharged into the discharge unit 5 without losing any image quality.

Fourth Embodiment

Next will be described a color laser printer 301 according to a third embodiment of the invention with reference to FIGS. 9 and 10.

Figure 9:
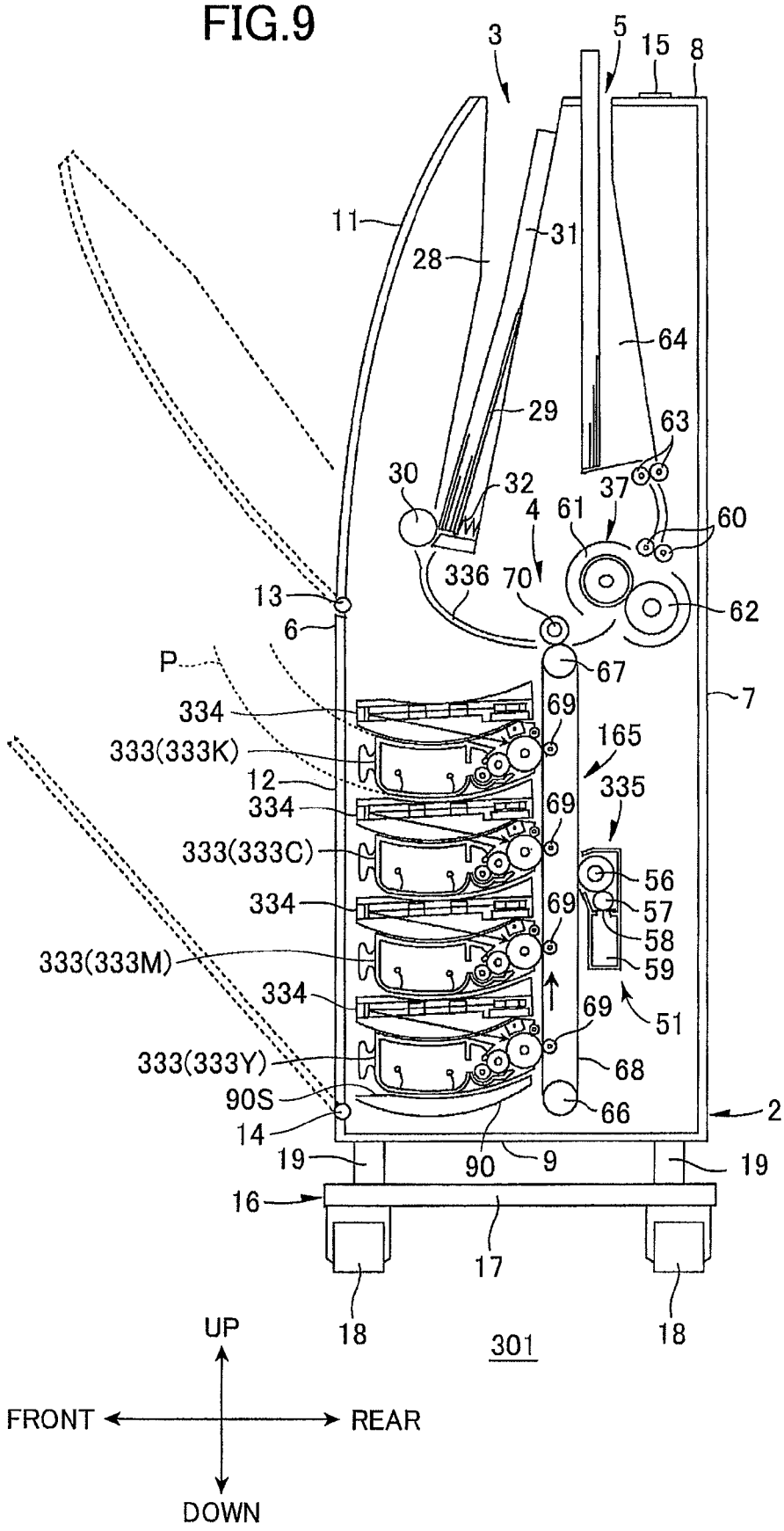
FIG. 9 is a side cross-sectional view of a color laser printer according to a fourth embodiment of the invention.

FIG. 9 is a side cross-sectional view of the color laser printer 301. FIG. 10 is an enlarged side cross-sectional view of a process unit 333 and scanning unit 334 shown in FIG. 9. Below, only configurations of the fourth embodiment that differ from the first embodiment will be described, while the construction similar to the first embodiment is omitted. Further, like parts and components to those in the first embodiment are designated with the same reference numerals.

The color laser printer 301 of the present embodiment is the same as the color laser printer 1 of the first embodiment except that the printer 301 is of an intermediate transfer tandem type, that the positions of the paper supply unit 3 and discharge unit 5 in the front-to-rear direction are reversed to that in the first embodiment, and that the engine unit 4 of the present embodiment has a plurality of the process units 333, a plurality of the scanning units 334, a transfer unit 335, and a conveying path 336 in place of the plurality of process units 33, the plurality of scanning units 34, the transfer unit 335, and the conveying path 36 in the first embodiment.

A. General Structure of a Color Laser Printer

Unlike the first embodiment described above, the printer 301 of the present embodiment is configured of an intermediate transfer tandem color laser printer. Further, the positions of the paper supply unit 3 and discharge unit 5 in the front-to-rear direction are reversed to that in the first embodiment. Unlike in the first embodiment, the conveying path 336 is provided above the process units 333 and transfer unit 335.

B. Casing

As in the first embodiment described above, the casing 2 includes the upper cover 11 and lower cover 12. The upper cover 11 exposes and covers the sheet supply unit 3, and the lower cover 12 exposes and covers the engine unit 4. Unlike the first embodiment, in the fourth embodiment, the lower cover 12 does not support the transfer unit 335.

C. Paper Supply Unit

The paper supply unit 3 is disposed in the front side of the casing 2 above process units 333 in the engine unit 4. Similarly to the first embodiment, the paper supply unit 3 includes the paper holder 28, paper-pressing plate 29, and feeding roller 30.

The paper holder 28 is formed in the casing 2 as a recessed part for accommodating the paper 31. The paper holder 28 is shaped substantially rectangular from a front view, and the front side of the paper holder 28 is opened or covered by the upper cover 11. The top of the paper holder 28 is open, enabling the user to insert the paper 31 through the opening to load the paper 31 on the paper-pressing plate 29. When the upper cover 11 is opened, the paper holder 28 is exposed through the open upper cover 11, enabling the user to load the paper 31 through the front of the casing 2.

The paper 31 is maintained substantially in a vertical orientation in the paper holder 28 on the front side of the paper-pressing plate 29 and is stacked in a front-to-rear direction opposing the urging force of the compressed spring 32. The forwardmost sheet of the paper 31 stacked on the front side of the paper-pressing plate 29 is pressed against the feeding roller 30 by the urging force of the compressed spring 32. The feeding roller 30 rotates to feed the paper 31 toward the engine unit 4 one sheet at a time.

D. Engine Unit

The engine unit 4 of the present embodiment includes the plurality of the process units 333, plurality of scanning units 334, transfer unit 335, conveying path 336, and fixing unit 37. Thus, the engine unit 4 of the present embodiment has the process units 333, scanning units 334, transfer unit 335, and conveying path 336 in place of the process units 33, scanning units 34, transfer unit 35, and conveying path 36 in the first embodiment.

a. Process Units

Similarly to the first embodiment, in the fourth embodiment, four of the process units 333 are provided in the casing 2 for each of four different colors. The process units 333 are positioned in the front section of the casing 2 below the paper supply unit 3 and discharge unit 5. The process units 333 are detachably mounted in the casing 2.

By opening the lower cover 12 to the position indicated by the dotted line, each process unit 333 can be independently mounted in or removed from the casing 2 in the front-to-rear direction. The mounted process units 333 are covered when the lower cover 12 is closed in the position indicated by the solid line.

Figure 10:
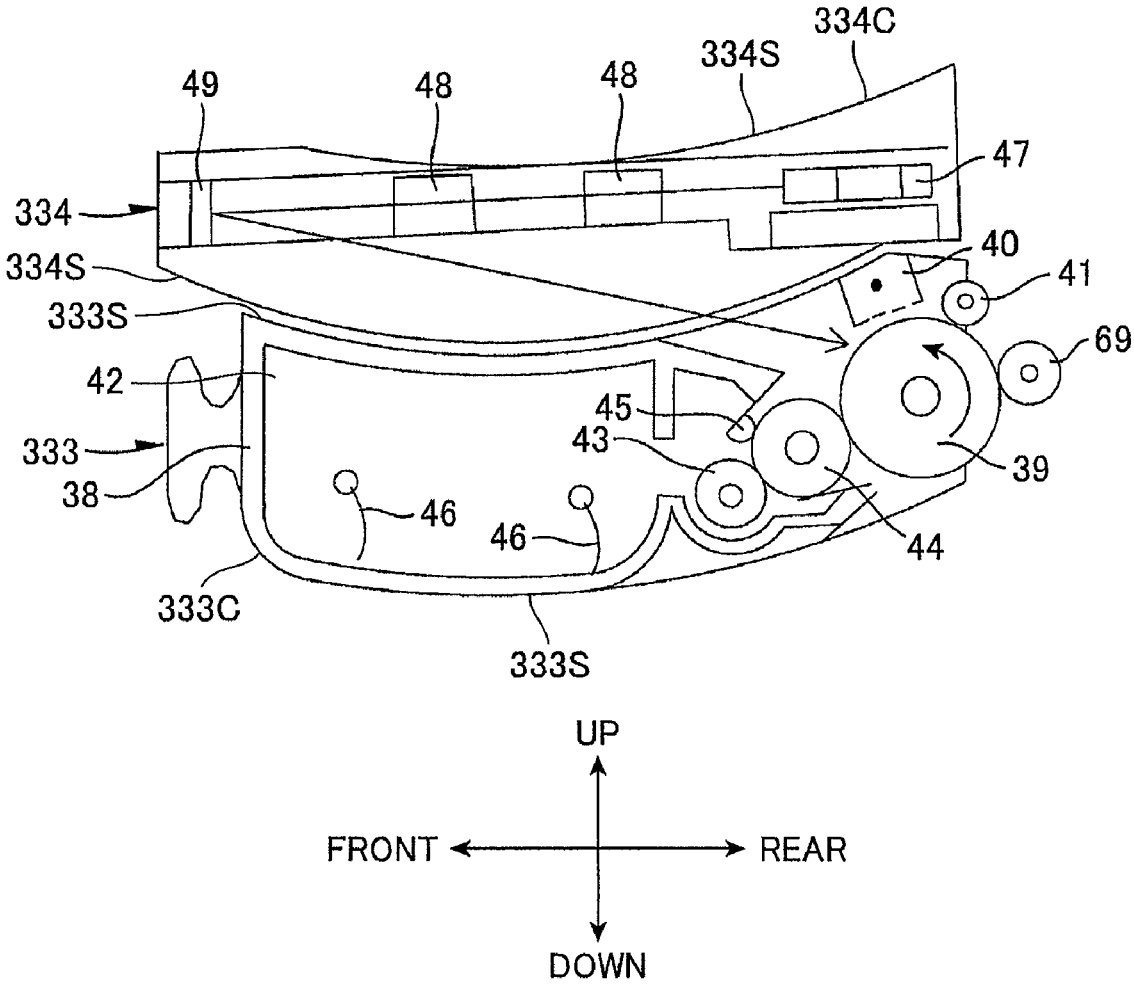
FIG. 10 is an enlarged side cross-sectional view of a process unit and scanning unit shown in FIG. 9.

As shown in FIG. 10, each process unit 333 includes a casing 333*c* with a pair of opposite arcing surfaces 333*s*. Each process unit 333 includes, within the casing 333*c*, the developer cartridge 38, the photosensitive drum 39, the Scorotron charger 40, and the drum cleaning roller 41. These components 38, 39, 40, and 41 are disposed on the opposite side in the front-to-rear direction from the side described in the first embodiment.

Specifically, the developer cartridge 38 is located in the front section of the casing 333*c*, and the toner-accommodating section 42 is an internal space formed in the front side of the developer cartridge 38. The agitators 46 disposed in the toner-accommodating section 42 rotate to agitate toner accommodated therein. Through the agitation of the agitators 46, some of the toner is discharged toward the supply roller 43 through a toner supply opening formed in the rear side of the toner-accommodating section 42.

The supply roller 43 is rotatably disposed to the rear of the toner supply opening. The developing roller 44 is rotatably disposed to the rear of the supply roller 43 and in confrontation with the same. Further, the developing roller 44 is positioned so that a rear portion thereof is exposed through an opening formed in the rear side of the developer cartridge 38.

The thickness-regulating blade 45 is disposed near the top of the developing roller 44 so that the pressing part contacts the surface of the developing roller 44 with pressure.

Toner discharged through the toner supply opening is supplied onto the developing roller 44 by the rotating supply roller 43. At this time, the toner is positively tribocharged between the supply roller 43 and the developing roller 44. As the developing roller 44 rotates, toner carried on the surface of the developing roller 44 passes beneath the pressing part of the thickness-regulating blade 45 so that a thin layer of uniform thickness is carried on the developing roller 44.

The photosensitive drum 39 is disposed on the rear side of the developing roller 44 and is capable of rotating in the process unit 333 while in contact with the developing roller 44. Further, the photosensitive drum 39 is positioned so that a rear portion of the photosensitive drum 39 is exposed through an opening formed in the rear side of the process unit 333.

The charger 40 is disposed above the photosensitive drum 39 with a prescribed amount of separation so as not to contact the photosensitive drum 39.

The drum cleaning roller 41 is rotatably disposed in the process unit 333 so as to contact the photosensitive drum 39 at a position upstream of the charger 40 with respect to the rotational direction of the photosensitive drum 39.

A toner image of each color is formed on the photosensitive drum 39 in each process unit 333 through the same process described in the first embodiment.

b. Scanning Unit

As shown in FIG. 9, the scanning units 334 are disposed in the casing 2 below the paper supply unit 3 and discharge unit 5. Four of the scanning units 334 are fixed to the casing 2 at positions corresponding to the process units 333 provided for each color. The scanning units 334 are arranged to be stacked vertically at prescribed intervals so that each scanning unit 334 is disposed above the corresponding process unit 333. Hence, the process units 333 and scanning units 334 are alternately stacked in the vertical direction within the casing 2.

As shown in FIG. 10, similarly to the scanning unit 34 of the first embodiment, each scanning unit 334 has a casing 334*c* with upper and lower guiding surfaces 334*s*. Each scanning unit 334 includes, within the casing 334*c*, the laser light-emitting unit (not shown), polygon mirror 47, two lenses 48, and reflecting mirror 49. The laser-light emitting unit (not shown) emits a laser beam based on prescribed image data. As indicated by the arrow in FIG. 10, the laser beam sequentially passes through or is reflected by the polygon mirror 47, the two lenses 48, and the reflecting mirror 49 and is subsequently irradiated in a high-speed scan onto the surface of the respective photosensitive drum 39, as described above.

Similarly to the first embodiment, the guiding member 90 having the upper guiding surface 90*s* is provided in the casing 2. Similarly to the first embodiment, the upper and lower guiding surfaces 334*s* of the casing 334*c* in each scanning unit 334 and the upper guiding surface 90*s* of the guiding member 90 follow the curved path P. The pair of opposite arcing surfaces 333*s* of the casing 333*c* in each process unit 333 can follow the curved path P. Thus, similarly to the first embodiment, when mounting or removing each process unit 333, the process unit 333 is guided by its upper scanning unit 334 and by its lower member (scanning unit 334 or guiding member 90) along the curved path P.

c. Transfer Unit

As shown in FIG. 9, the transfer unit 335 is provided in the casing 2 between the process units 333 and the rear wall 7. The transfer unit 335 is oriented vertically so as to oppose each of the process units 333 stacked vertically in the casing 2. The transfer unit 335 includes an intermediate transfer unit 165, and the belt cleaner unit 51.

The intermediate transfer unit 165 extends vertically so as to oppose each of the photosensitive drums 39, which are arranged to be stacked vertically, and is positioned substantially in the front-to-rear center of the casing 2. The intermediate transfer unit 165 is the same as the intermediate transfer unit 65 of the third embodiment except that only one follow roller 66 is provided in place of the two follow rollers 66, that the drive roller 67 is disposed higher than the photosensitive drum 39 of the topmost black process unit 333K, and that the follow roller 66 is disposed lower than the photosensitive drum 39 of the bottommost yellow process unit 333Y.

The conveying belt 68 is looped around the drive roller 67 and the follow roller 66 so that the outer surface of the conveying belt 68 on the forward facing side contacts all of the photosensitive drums 39 in the process units 333.

When the drive roller 67 is driven to rotate, the follow roller 66 follows this rotation as the conveying belt 68 circulates around the drive roller 67 and follow roller 66 so that the outer surface of the conveying belt 54 or the front side contacting the photosensitive drums 39 moves in the same direction as the surfaces of the photosensitive drums 39 at the contact points.

The primary transfer rollers 69 are disposed inside the conveying belt 68 at positions opposing the photosensitive drums 39 so as to pinch the conveying belt 68 therebetween. Each primary transfer roller 69 is configured of a metal roller shaft that is covered with an electrically conductive rubber roller. The primary transfer rollers 69 are disposed in contact with the inner surface of the conveying belt 68 on the front side and rotate in a direction conforming to the circular movement of the conveying belt 68. During a transfer operation, a power supply (not shown) applies a primary transfer bias to the primary transfer rollers 69.

The secondary transfer roller 70 is disposed outside the conveying belt 68 at a position above and opposing the drive roller 67 so as to pinch the conveying belt 68 therebetween. The secondary transfer roller 70 is configured of a metal roller shaft that is covered with an electrically conductive rubber roller. The secondary transfer roller 70 is disposed in contact with the outer surface of the conveying belt 68 on the top side and rotates in a direction conforming to the circular movement of the conveying belt 68. During a transfer operation, a power supply (not shown) applies a secondary transfer bias to the secondary transfer roller 70.

The belt cleaner unit 51 has the same construction as that described in the first embodiment and is disposed on the opposite side (rear side) of the conveying belt 68 from the photosensitive drums 39. The belt cleaner unit 51 is positioned between the drive roller 67 and follow roller 66 vertically so that the cleaning roller 56 contacts the outer surface of the conveying belt 68 in the rear section.

d. Conveying Path

The conveying path 336 is formed above the process units 333 for conveying the paper 31 from the paper supply unit 3 to the discharge unit 5. Along the way, the conveying path 336 passes between the drive roller 67 of the intermediate transfer unit 165 and the secondary transfer roller 70, and between the heating roller 61 and pressure roller 62 in the fixing unit 37. Rather than forming a large U-shape that passes around the lowermost yellow process unit 333Y, as in the first embodiment, the conveying path 336 according to the fourth embodiment is a short path formed in the upper section of the casing 2 and having a U-shape for passing between the drive roller 67 and the secondary transfer roller 70.

A pair of conveying rollers 60 is provided along the conveying path 336 downstream of the fixing unit 37 for conveying the paper 31.

e. Fixing Unit

The fixing unit 37 is disposed in the casing 2 vertically above and rearward of a secondary transfer position between the drive roller 67 of the intermediate transfer unit 165 and the secondary transfer roller 70. The heating roller 61 and pressure roller 62 in the fixing unit 37 are arranged in opposition to each other on the conveying path 336.

f. Image Formation in the Engine Unit

The paper 31 supplied from the paper supply unit 3 is conveyed along the conveying path 336 so as to take a U-turn between the drive roller 67 and the secondary transfer roller 70.

In the meantime in the transfer unit 335, the drive roller 67 is driven, and the conveying belt 68 moves in a circular path as the follow roller 66 follows. Toner images in each color formed on each photosensitive drum 39 are sequentially transferred onto the conveying belt 68, forming a full-color image thereon. The full-color image formed on the conveying belt 68 is subsequently transferred altogether onto the paper 31 as the paper 31 passes between the drive roller 67 and the secondary transfer roller 70.

After a full-color image has been formed on the paper 31, the image is fixed to the paper 31 in the fixing unit 37, and the paper 31 is conveyed to the discharge unit 5.

E. Discharge Unit

The discharge unit 5 is disposed in the casing 2 above and rearward of the process units 333 in the engine unit 4. The discharge unit 5 also opposes and is separated a prescribed distance from the paper supply unit 3 horizontally in the front-to-rear direction. The discharge unit 5 includes the discharge rollers 63 and the discharge holder 64.

The discharge rollers 63 are disposed above the fixing unit 37 and below the discharge holder 64. After a full-color image has been fixed by heat to the paper 31 in the fixing unit 37, the discharge rollers 63 discharge the paper 31 into the discharge holder 64.

The discharge holder 64 is provided in the casing 2 as a recessed part formed substantially in the shape of a rectangle when viewed from the front side and is capable of accommodating sheets of the paper 31. The top side of the discharge holder 64 is open, and the vertical depth of the discharge holder 64 is set so that the discharged paper 31 is exposed through the open top side of the discharge holder 64. Hence, when the discharge rollers 63 discharge the paper 31, the paper 31 is maintained substantially vertically inside the discharge holder 64 so that the top edge of the paper 31 protrudes from the casing 2. Sheets of the discharged paper 31 are therefore stacked in a front-to-rear direction in the discharge holder 64.

F. Effects of the Fourth Embodiment

In the printer 301 of the fourth embodiment described above, prior to image formation the paper 31 is maintained substantially in a vertical orientation within the paper holder 28 of the paper supply unit 3 positioned above and forward of the process units 333, and more specifically the uppermost black process unit 333K. After image formation, the paper 31 is maintained substantially in a vertical orientation within the discharge holder 64 of the discharge unit 5 positioned above and rearward of the process units 333, and more specifically the uppermost black process unit 333K. Hence, as in the printer 1 according to the first embodiment, the footprint of the printer 301 can be reduced, while the printer 301 is provided with a plurality of the process units 333, regardless of the surface area of the paper 31.

Further, in the printer 301 described above, each of the process units 333 can be mounted into or removed from the casing 2 in a front-to-rear direction by opening the lower cover 12 to expose the process units 333. Hence, the process units 333 can easily be mounted in or removed from the casing 2 without interference from the paper supply unit 3 and discharge unit 5 disposed thereabove.

Further, in the printer 301 described above, the paper holder 28 is opened by opening the upper cover 11, enabling the paper 31 to be stacked in the paper holder 28 on the paper-pressing plate 29. Further, since the upper cover 11 pivots about the upper shaft 13 extending in the width direction, the upper cover 11 can be more widely opened over the paper holder 28 of the paper supply unit 3 than if the upper cover 11 were to pivot about a comparative shaft that extends in the front-to-rear direction.

In the printer 301 of the fourth embodiment, the process units 333 are exposed when the lower cover 12 is opened, enabling the user to mount or remove the process units 333 individually. Further, since the lower cover 12 pivots about the lower shaft 14 extending in the width direction, the lower cover 12 can be more widely opened over the process units 333 than if the lower cover 12 were to pivot about a comparative shaft that extends in the front-to-rear direction.

In the printer 301 of the fourth embodiment, the upper cover 11 is disposed above the lower cover 12 so that the upper cover 11 and lower cover 12 can be opened and closed independently without interfering with each other. Hence, the paper holder 28 of the paper supply unit 3 can be exposed or covered by opening and closing the upper cover 11, while the process units 333 can be exposed or covered by independently opening and closing the lower cover 12.

In the printer 301 according to the fourth embodiment, a primary transfer is performed with the intermediate transfer unit 165 to superpose color toner images from each photosensitive drum 39 on the conveying belt 68. Subsequently, a secondary transfer is performed to transfer the superposed color toner images (full-color image) onto the paper 31. Hence, this construction achieves an intermediate transfer tandem device.

In the printer 301 having this construction, the conveying path 336 is disposed above the process units 333 and describes a short path, thereby simplifying a process for resolving paper jams in the conveying path 336.

Fifth Embodiment

Next will be described a color laser printer 401 according to a fifth embodiment of the invention with reference to FIGS. 11-16.

Figure 11:
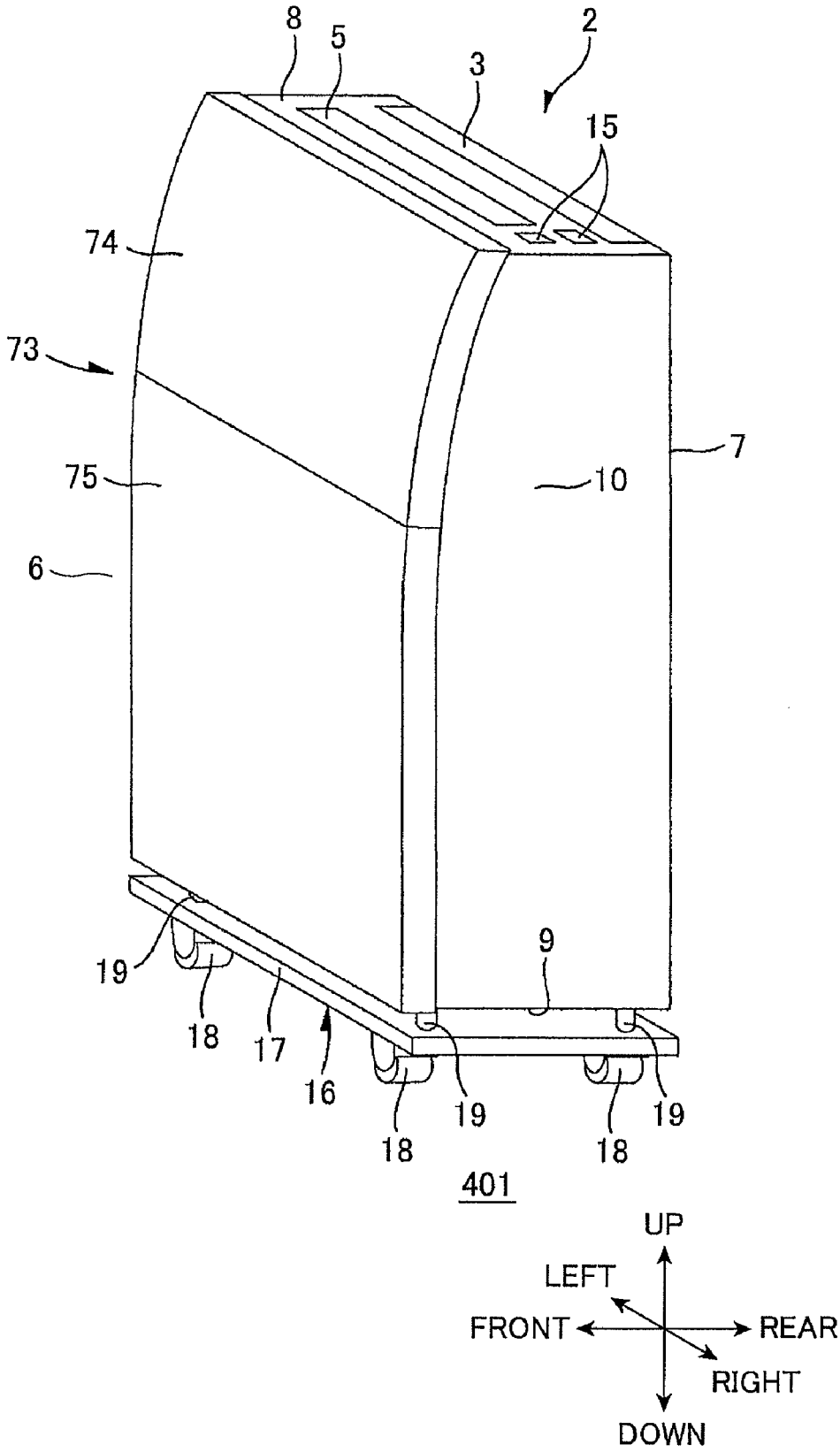
FIG. 11 is a perspective view from a front surface side of a color laser printer according to a fifth embodiment of the invention.
Figure 12:
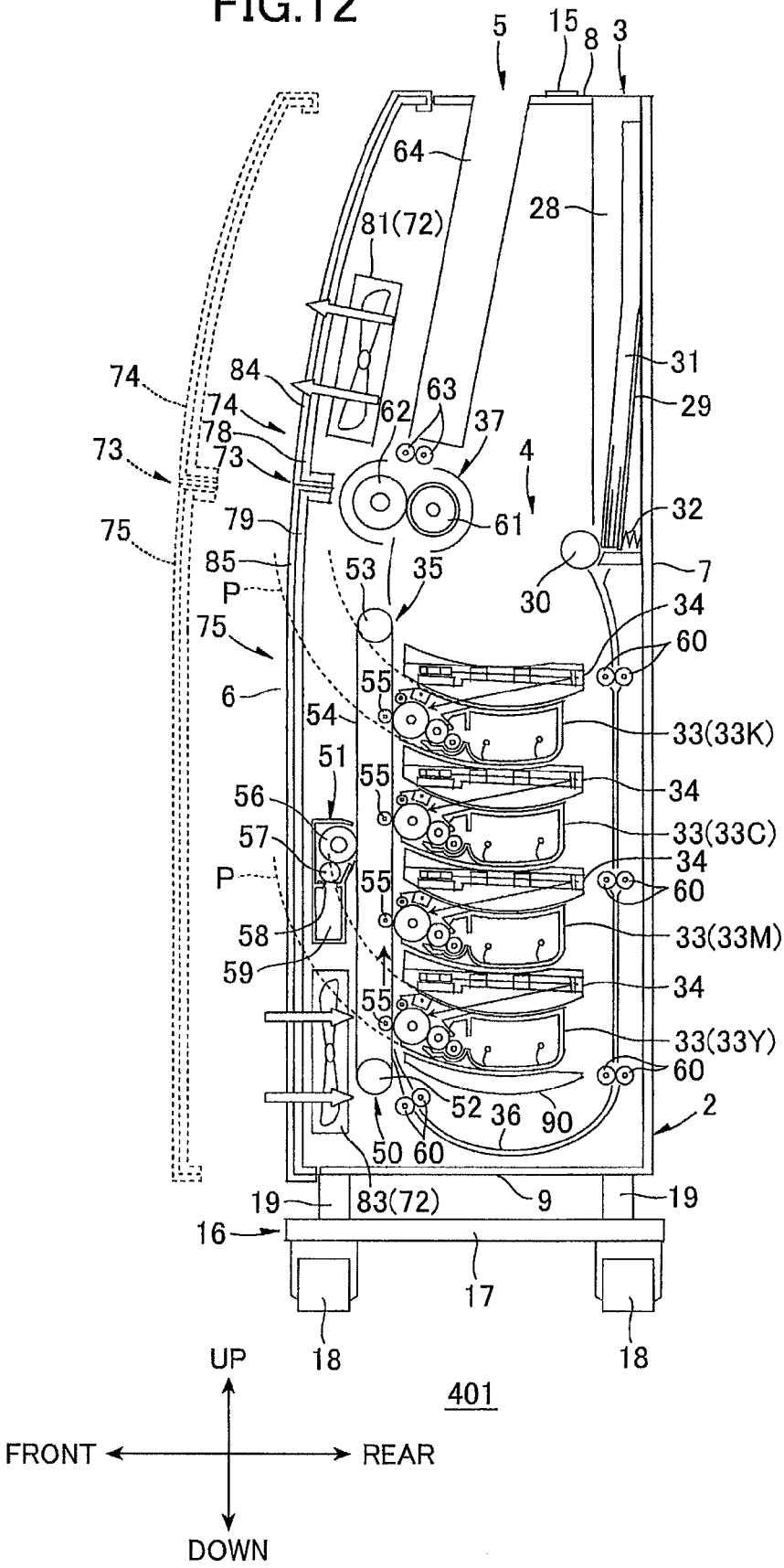
FIG. 12 is a side cross-sectional view of the color laser printer in FIG. 11.

FIG. 11 is a perspective view from the front side of the color laser printer 401. FIG. 12 is a side cross-sectional view of the color laser printer 401.

Below, only configurations of the second embodiment that differ from the first embodiment will be described, while the construction similar to the first embodiment is omitted. Further, like parts and components to those in the first embodiment are designated with the same reference numerals.

The color laser printer 401 of the present embodiment is the same as the color laser printer 1 of the first embodiment except for the following points: That is, an ornamental panel set 73 is provided in place of the upper and lower covers 11 and 12. The ornamental panel set 73 has an upper ornamental panel 74 and a lower ornamental panel 75. The transfer unit 53 is not fixed on the ornamental panel set 73, but is simply mounted in the casing 2. A set of ventilating fans 72 is mounted inside the casing 2. The set of ventilating fans 72 includes an exhaust fan 81 and an intake fan 83.

The exhaust fan 81 is fixed to the inside of the casing 2 at a center position in the upper section thereof (see FIG. 14) so as to be positioned above the fixing unit 37 and forward of the discharge unit 5. The exhaust fan 81 discharges air out of the casing 2.

The intake fan 83 is disposed on the inside of the casing 2 in a right side portion of the lower section (see FIG. 14) so as to be positioned lower than the belt cleaner unit 51 and forward of the transfer belt unit 50. The intake fan 83 draws external air into the casing 2.

Hence, the intake fan 83 disposed in the lower section of the casing 2 draws external air into the casing 2, after which she exhaust fan 81 disposed in the upper section of the casing 2 exhausts this air out of the casing 2. In this way, an airflow is produced in the casing 2 from the intake fan 83 in the lower section to the exhaust fan 81 in the upper section. Accordingly, heat generated during an image-forming operation is carried along this airflow and effectively exhausted.

Further, since the exhaust fan 81 is positioned near the top of the fixing unit 37, heat produced by the fixing unit 37 in a fixing operation can be effectively discharged.

According to the present embodiment, the ornamental panel set 73 is disposed on the front surface 6 of the casing 2 for covering the same in place of the upper and lower covers 11 and 12 in the first embodiment. The ornamental panel set 73 is detachably mounted on the front surface 6 of the casing 2. Fitting parts (not shown) are provided around a peripheral frame portion of the casing 2 around the front surface 6 (that is, the peripheral front edge of the bottom wall 9, the top wall 5, and the side walls 10) for detachably mounting the ornamental panel set 73 thereon.

The ornamental panel set 73 includes the upper ornamental panel 74 for covering the upper section on the front surface 6 of the casing 2, and the lower ornamental panel 75 for covering the lower section on the front surface 6 of the casing 2.

As shown in FIG. 12, the transfer unit 35 is disposed in the casing 2 between the process units 33 and the lower ornamental panel 75. Accordingly, the process units 33 are exposed to the outside by detaching the lower ornamental panel 75 as indicated by a dotted line in the drawing and then by detaching the transfer unit 35. At this time, the process units 33 can be independently mounted in or removed from the casing 2 in a front-to-rear direction along the curved path P similarly to the first embodiment. After mounting the transfer unit 35, the lower ornamental panel 75 is mounted, as indicated by the solid line, to cover the process units 33. It is noted that when the transfer unit 35 is detached or mounted with respect to the casing 2, the transfer belt unit 50 and belt cleaner unit 51 can be mounted and removed together.

The upper ornamental panel 74 includes an upper cover plate 78, and an upper ornamental plate 84 supported on the upper cover plate 78. The lower ornamental panel 75 includes a lower cover plate 79, and a lower ornamental plate 85 that is supported on the lower cover plate 79.

Figure 13:
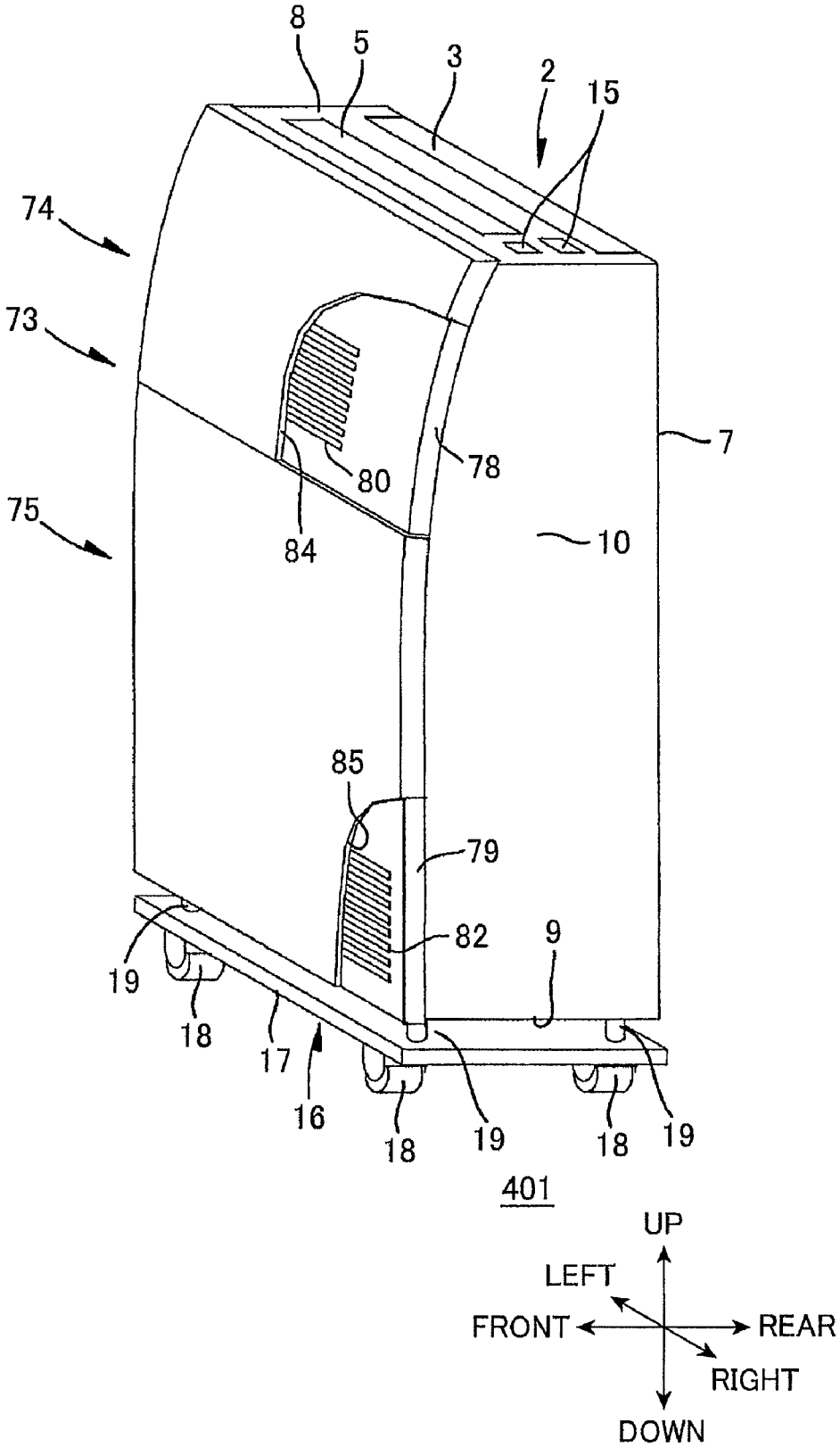
FIG. 13 is a perspective view from a front surface side showing the color laser printer of the fifth embodiment, in which a portion of the upper and lower ornamental plates have been taken away.
Figure 14:
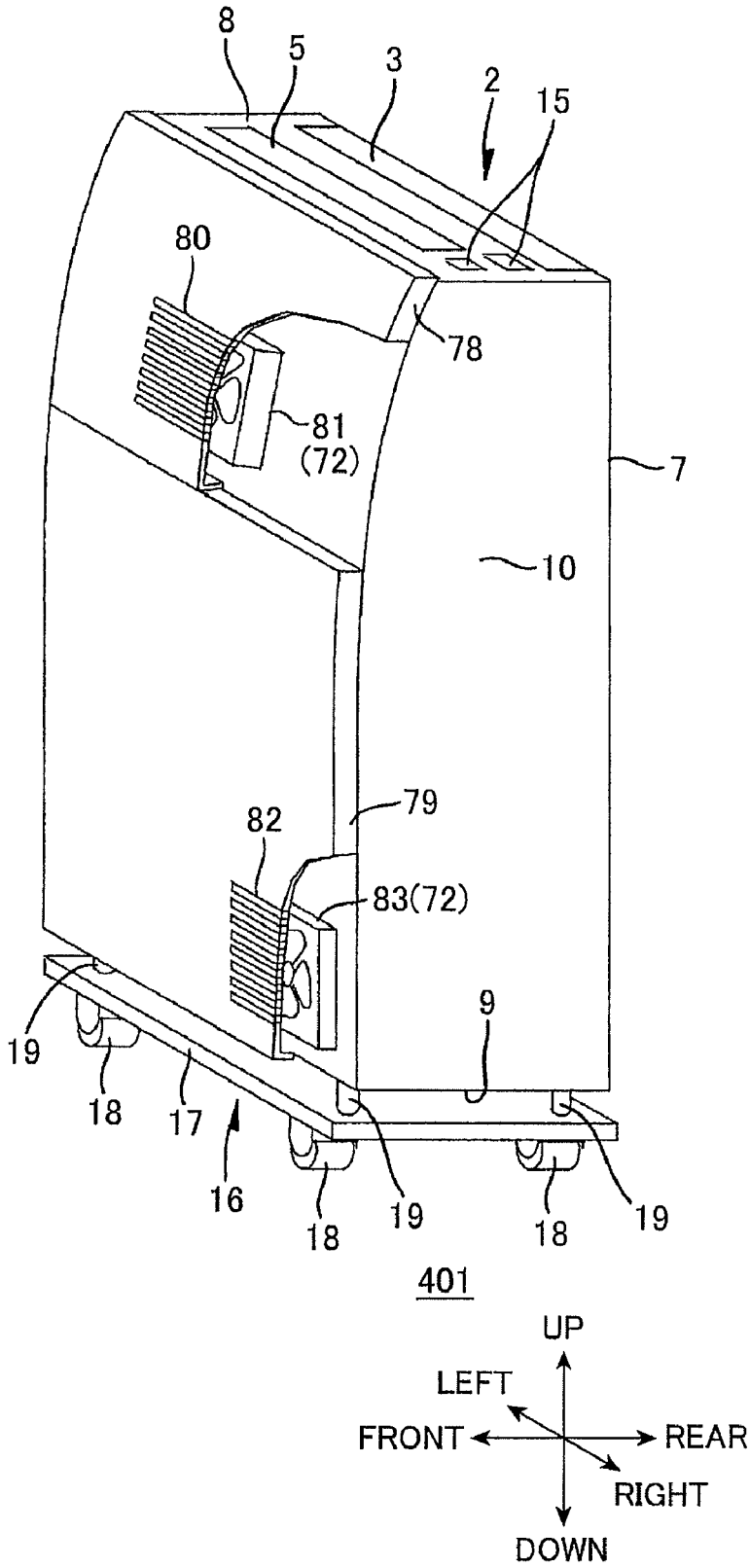
FIG. 14 is a perspective view from a front surface side of the color laser printer of the fifth embodiment in which the upper and lower ornamental plates of FIG. 13 have been removed, and a portion of the upper and lower covers nave been taken away.

FIG. 13 is a perspective view from a front side of the color laser printer 401 in which portions of the upper ornamental plate 84 and the lower ornamental plate 85 have been cut away. FIG. 14 is a perspective view from a front surface side of the color laser printer 401 in which the upper ornamental plate 84 and lower ornamental plate 85 have been removed, and a portion of the upper cover plate 78 and lower cover plate 79 have been cut away.

The upper cover plate 78 is formed of a hard synthetic resin that expands vertically and in the width direction to form a rectangular plate shape in a front view. From the bottom edge toward the top, the upper cover plate 78 slopes along a curve toward the rear wall 7. The peripheral edges of the upper cover plate 78 are also bent rearward and are capable of fitting into the fitting parts (not shown) provided on the front edge of the casing 2.

As shown in FIG. 13, an outlet 80 is formed in a center region of the upper cover plate 78 for allowing air discharged by the exhaust fan 81 to pass out of the casing 2.

The outlet 80 formed in the center region of the upper cover plate 78 is configured of a plurality of narrow slits arranged parallel to one another and separated at prescribed intervals in the vertical direction, and extending in the width direction, while penetrating the upper cover plate 78 in the thickness direction.

As shown in FIG. 12, the upper ornamental plate 84 is superposed over the front surface of the upper cover plate 78 in the form of a sheet that follows the outer shape of the upper cover plate 78. Further, the upper ornamental plate 84 is superposed so as to cover the peripheral edges of the upper cover plate 78. Further, the upper ornamental plate 84 is formed of a material that has a plurality of through-holes passing therethrough in the front-to-rear direction, that is, the thickness direction. Representative examples of the material include wood, fibers, and foam material. In this example, the upper ornamental plate 84 is formed of a material selected from wood, fibers, and foam material.

When forming the upper ornamental plate 84 of wood, the wood material may be raw lumber, laminated wood, laminated veneer lumber, and chemically modified wood, for example. However, it is preferable to use a material formed by grinding these wood materials into chips and pressing the chips into a sheet form in which a plurality of through-holes are formed. For example, cork may be used. After this wood material is formed into a sheet-like shape, similar to the upper cover plate 78, the material is fixed or bonded to the front surface, including the peripheral edges, of the upper cover plate 78, thereby completing the upper ornamental plate 84.

When forming the upper ornamental plate 84 of fibers, it is possible to use chemical fibers or natural fibers, for example. It is preferable that these fibers are pressed into a web-like formation with a plurality of through-holes formed therein. This type of fiber is then formed in a sheet-like shape conforming to the shape of the upper cover plate 78 and subsequently fixed or bonded to the front surface, including the peripheral edges, of the upper cover plate 78 to complete the upper ornamental plate 84.

When the upper ornamental plate 84 is formed of a foam material, it is possible to use polyolefin foam material, polystyrene foam material, or polyurethane foam material. Preferably this material is formed in a sheet-like shape having continuous air bubbles in the thickness direction. After this foam material is formed in a sheet-like shape conforming to the shape of the upper cover plate 78, the material is fixed to the front surface, including the peripheral edges, of the upper cover plate 78 to complete the upper ornamental plate 84.

Further, when the upper ornamental plate 84 is formed of fibers or foam material, it is preferable that the fibers or foam material contain a deodorizer. This deodorizer may be an activated carbon or other agent well known in the art. Further, in addition to the deodorizer, the fibers or foam material may contain a deodorant, disinfecting agent, antibacterial agent, fragrance, and the like well known in the art.

As shown in FIG. 12, the upper ornamental panel 74 is detachably mounted on the front surface of the casing 2 in the upper section thereof so as to oppose the exhaust fan 81 and the discharge unit 5 in the front-to-rear direction. The upper ornamental panel 74 covers the upper section of the casing 2 from the top wall 8 of the casing 2 to the fixing unit 37.

When mounting the upper ornamental panel 74 on the casing 2, the peripheral edges of the upper cover plate 78 are fitted into the fitting parts (not shown) on the casing 2 so that the upper cover plate 78 is fitted into the upper front surface of the casing 2. When detaching the upper ornamental panel 74 from the casing 2, the peripheral edges of the upper cover plate 78 are disengaged from the fitting parts, and the upper cover plate 78 is removed from the upper front surface of the casing 2.

When the upper ornamental panel 74 is mounted on the casing 2, the upper cover plate 78 covers the exhaust fan 81 and the discharge unit 5, as indicated by the solid line in FIG. 12. In this state, the outlet 80 of the upper cover plate 78 opposes the exhaust fan 81, as shown in FIG. 14. When the upper ornamental panel 74 is removed from the casing 2, as indicated by the dotted line in FIG. 12, the exhaust fan 81 and the discharge unit 5 are exposed.

The lower cover plate 79 is formed of a hard synthetic resin that expands vertically and in the width direction to form a rectangular plate shape in a front view that is flat from the bottom edge toward the top edge. Further, the peripheral edges of the lower cover plate 79 are also bent rearward and are capable of fitting into the fitting parts (not shown) provided on the front edge of the casing 2.

As shown in FIG. 13, an inlet 82 is formed in a lower-right side region of the lower cover plate 79. The inlet 82 has through-holes that allow the intake fan 83 to draw air into the casing 2. Specifically, the inlet 82 disposed in the lower-right side section of the lower cover plate 79 is configured of a plurality of narrow slits arranged parallel to each other and separated at prescribed intervals in the vertical direction. The slits extend in the width direction and penetrate the lower cover plate 79 in the thickness direction.

As shown in FIG. 12, the lower ornamental plate 85 is superposed over the front surface of the lower cover plate 79 in the form of a sheet that follows the outer shape of the lower cover plate 79. Further, the lower ornamental plate 85 is superposed so as to cover the peripheral edges of the lower cover plate 79.

Further, the lower ornamental plate 85 is formed of a material that has a plurality of through-holes passing therethrough in the front-to-rear direction, that is, the thickness direction. Representative examples of the material include wood, fibers, and foam material. In this example, the lower ornamental plate 85 is formed of a material selected from wood, fibers, and foam material.

The same materials and methods described above for the upper ornamental plate 84 are used when forming the lower ornamental plate 85 of a material selected from wood, fibers, and foam material.

As with the upper ornamental plate 84, when forming the lower ornamental plate 85 from fibers or foam material, it is preferable that the fibers or foam material contain a deodorizer similar to that described for the upper ornamental plate 84. In addition to the deodorizer, the fibers or foam material may contain a deodorant, disinfecting agent, antibacterial agent, fragrance, and the like well known in the art.

As shown in FIG. 12, the lower ornamental panel 75 is detachably mounted on the front surface of the casing 2 in the lower section thereof so as to oppose the intake fan 83, transfer unit 35, and process units 33 in the front-to-rear direction. The lower ornamental panel 75 covers the lower section of the casing 2 from the bottom wall 9 of the casing 2 to the fixing unit 37.

When mounting the lower ornamental panel 75 on the casing 2, the peripheral edges of the lower cover plate 79 are fitted into the fitting parts (not shown) on the casing 2 so that the lower cover plate 79 is fitted into the lower front surface of the casing 2. When detaching the lower ornamental panel 75 from the casing 2, the peripheral edges of the lower cover plate 79 are disengaged from the fitting parts, and the lower cover plate 79 is removed from the lower front surface of the casing 2.

When the lower ornamental panel 75 is mounted on the casing 2, the lower cover plate 79 covers the intake fan 83, transfer unit 35, and process units 33, as indicated by the solid line in FIG. 12. In this state, the inlet 82 of the lower cover plate 79 opposes the intake fan 83, as shown in FIG. 14. When the lower ornamental panel 75 is removed from the casing 2, as indicated by the dotted line in FIG. 12, the intake fan 83, transfer unit 35, and process units 33 are exposed.

Figure 15:
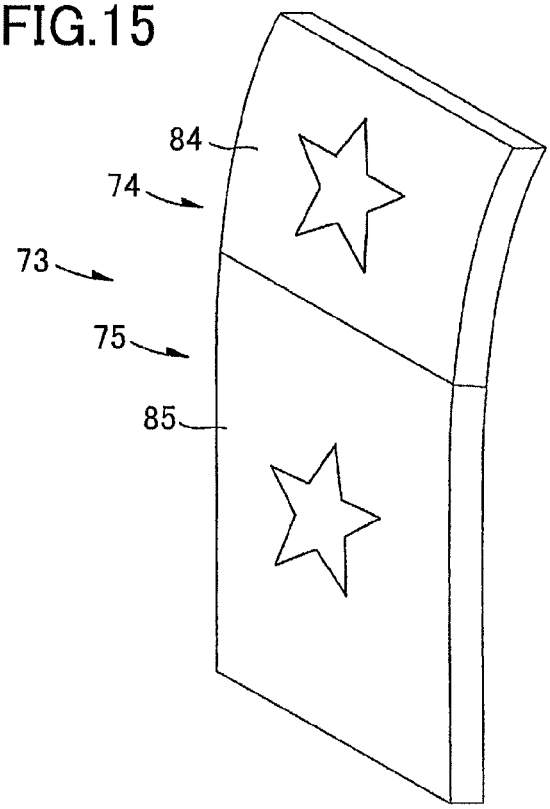
FIG. 15 is a perspective view showing an upper ornamental panel and lower ornamental panel according to a variation of the fifth embodiment.
Figure 16:
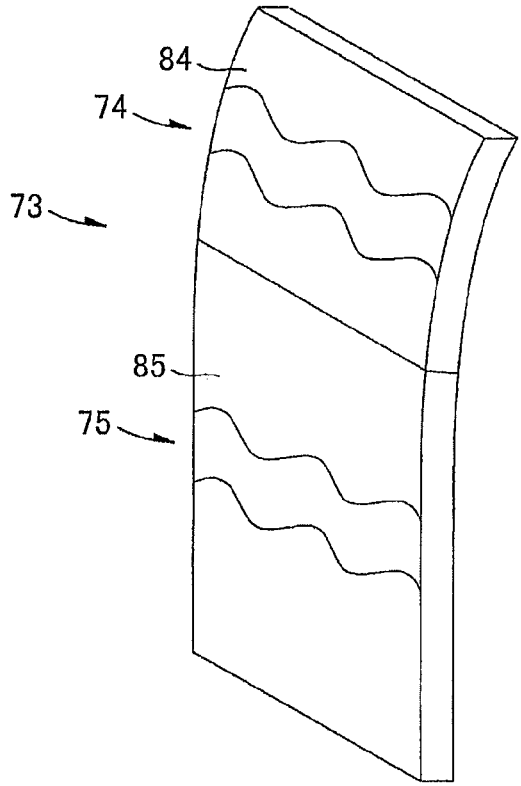
FIG. 16 is a perspective view showing an upper ornamental panel and lower ornamental panel according to another variation of the fifth embodiment.

While the front surfaces of the upper ornamental plate 84 and lower ornamental plate 85 are formed without patterns in the upper ornamental panel 74 and lower ornamental panel 75 described above, it is possible to form star patterns, for example, on the front surfaces of the upper ornamental plate 84 and lower ornamental plate 85, as shown in FIG. 15, or to form a wave-like pattern on the front surface of the upper ornamental plate 84 and lower ornamental plate 85, as shown in FIG. 16. These plates having different patterns can be interchanged as desired.

It is preferable to prepare, as a set of ornamental plates, a plurality of different pairs of ornamental plates 84 and 85 that have different designs or appearances from one another. For example, the set of ornamental plates include: the pair of ornamental plates 84 and 85 without patterns shown in FIG. 11, the pair of ornamental plates 84 and 85 with star patterns shown in FIG. 15, and the pair of ornamental plates 84 and 85 with wave-like patterns shown in FIG. 16. It is possible to change the external appearance of the printer 401 by changing one pair of ornamental plates 84 and 85 that is presently being mounted on the printer 401 with another pair of ornamental plates 84 and 85 that has a different design from the presently-being-mounted pair of ornamental plates 84 and 85.

G. Operations and Effects of the Present Embodiment

In the printer 401 of the present embodiment, the ornamental panel 73 configured of the upper ornamental panel 74 and lower ornamental panel 75 covers the front surface of the casing 2. Hence, the ornamental panel 73 can protect the interior of the casing 2. Further, the upper ornamental panel 74 and lower ornamental panel 75 each have the upper ornamental plate 84 and lower ornamental plate 85, respectively, that are formed of a material selected from wood, fibers, and foam material. Accordingly, dirt and scratches are less likely to be noticeable, enabling the outer appearance of the ornamental panel 73 to be maintained for a long period of time. Further, this ornamental panel 73 improves the interior design of the printer 401.

Further, the upper ornamental panel 74 and lower ornamental panel 75 include the upper cover plate 78 and lower cover plate 79, respectively, for supporting the upper ornamental plate 84 and lower ornamental plate 85. These cover plates increase the stiffness of the upper ornamental panel 74 and lower ornamental panel 75 and improve the durability of the same.

Since the upper cover plate 78 and lower cover plate 79 that cover and expose the casing 2 are generally operated by the user, these members are particularly susceptible to scratches and dirt from handling. However, since the upper cover plate 78 and lower cover plate 79 are covered by the upper ornamental plate 84 and lower ornamental plate 85 in the present embodiment, scratches or dirt from handling are not easily noticeable and, hence, the external appearance of the upper cover plate 78 and lower cover plate 79 can be maintained over a long period of time.

Further, the outlet 80 and inlet 82 are formed in the upper cover plate 78 and lower cover plate 79, respectively, and a plurality of through-holes are formed through the upper ornamental plate 84 and lower ornamental plate 85 in the thickness direction. Accordingly, air discharged by the exhaust fan 81 can be efficiently exhausted out of the casing 2 through the upper cover plate 78. Further, the intake fan 83 can efficiently draw air into the casing 2 through the lower cover plate 79. As a result, the interior of the casing 2 can be efficiently ventilated, without impediments to the airflow from the intake fan 83 to the exhaust fan 81, thereby ensuring stable image formation by preventing problems in images formed by the process units 33 due to heat generated by the fixing unit 37 and the like.

Further, since a plurality of through-holes are formed through the upper ornamental plate 84 and lower ornamental plate 85, ventilation can be achieved while preventing dust and the like from entering the casing 2. Further, since the through-holes are not large openings, the through-holes do not detract from the external appearance.

In addition, the intake fan 83 is positioned opposite the inlet 82 of the lower cover plate 79 in the front-to-rear direction, while the exhaust fan 81 is positioned opposite the outlet 80 of the upper cover plate 78 in the front-to-rear direction. Accordingly, the intake fan 83 can efficiently draw air into the casing 2 through the lower ornamental plate 85 and inlet 82 of the lower ornamental panel 75. Further, the exhaust fan 81 can efficiently discharge air from the casing 2 through the outlet 80 and the upper ornamental plate 84 of the upper ornamental panel 74.

When the exhaust fan 81 is positioned opposite the outlet 80 of the upper cover plate 78, air exhausted by the exhaust fan 81 (for example, warm air that has absorbed the heat from the fixing unit 37) may directly blow on a person near the outlet 80, causing unpleasantness to that person. However, since the air exhausted by the exhaust fan 81 in the present embodiment indirectly contacts a person in the proximity through the upper ornamental plate 84, such unpleasantness can be greatly reduced.

When formed of fibers or foam material, the upper ornamental plate 84 and lower ornamental plate 85 contain a deodorizer capable of removing odor from air exhausted from the casing 2. Hence, the cleanliness of the environment around the printer 401 can be maintained.

Further, the upper ornamental panel 74 and lower ornamental panel 75 are detachably mounted on the casing 2. Hence, if the user is changing the interior design of the room, for example, the user can remove the current upper ornamental panel 74 and lower ornamental panel 75 (such as panels having no patterns on the front surfaces of the upper ornamental plate 84 and lower ornamental plate 85) and mount a different upper ornamental panel 74 and lower ornamental panel 75 (such as panels having a pattern like those shown in FIG. 15 and FIG. 16 formed on the front surfaces of the upper ornamental plate 84 and lower ornamental plate 85), thereby improving the exterior design to match the interior design of the room. Further, when the appearance of the upper ornamental panel 74 and lower ornamental panel 75 degrades due to dirt or the like, these panels may be replaced with a new upper ornamental panel 74 and lower ornamental panel 75, thereby improving durability.

Further, since the surface area on the front surface of the casing 2 is much larger than that of the top wall 8, bottom wall 9, and side walls 10, the appearance of this front surface is vital for the user's impression when the printer 401 is installed with the rear wall 7 against a wall of the room. In the printer 401 of the present embodiment, the upper ornamental panel 74 and lower ornamental panel 75 are mounted on the front surface of the casing 2 to provide a favorable image to the user.

In the printer 401 of the present embodiment, the exhaust fan 81 and the discharge unit 5 can be exposed by removing the upper ornamental panel 74 and can be covered by mounting the upper ornamental panel 74. Further, the intake fan 83, transfer unit 35, and process units 33 can be exposed by removing the lower ornamental panel 75 and can be covered by mounting the lower ornamental panel 75. Hence, it is possible to clean the exhaust fan 81 and remove paper jams from the discharge rollers 63 by detaching the upper ornamental panel 74. It is also possible to clean the intake fan 83 and mount or remove the transfer unit 35 and process units 33 by detaching the lower ornamental panel 75.

Further, the upper ornamental panel 74 and lower ornamental panel 75 are independently mounted on and removed from the front surface of the casing 2. Accordingly, the user can mount or remove the upper ornamental panel 74 and lower ornamental panel 75 from the same side of the casing 2, thereby improving operability. Further, providing the upper ornamental plate 84 and lower ornamental plate 85 on the upper ornamental panel 74 and lower ornamental panel 75, respectively, further improves the appearance of the casing 2.

The laser printer 401 of the above-described embodiment is provided by modifying the laser printer 1 of the first embodiment by replacing the upper and lower covers 11 and 12 with the upper and lower ornamental panels 74 and 75, by simply mounting the transfer unit 35 in the casing 2, and by adding the ventilating fan set 72. However, the laser printers 101-301 of the second through fourth embodiments may be modified in the same manner as described above. For example, the laser printer 101 of the second embodiment may be modified by replacing the upper and lower covers 11 and 12 with the upper and lower ornamental panels 74 and 75, by simply mounting the transfer unit 35 in the casing 2, and by adding the ventilating fan set 72. In this case, the paper supply unit 3 is disposed above the front side of the engine unit 4, while the discharge unit 5 is disposed above the rear side of the engine unit 4. That is, the positions of the paper supply unit 3 and the discharge unit 5 are reversed from their positions in the laser printer 401 of the fifth embodiments. In this case, the paper supply unit 3 can be exposed by removing the upper ornamental panel 74 and can be covered by mounting the upper ornamental panel 74. Accordingly, the user can load the paper 31 in the paper holder 28 on the paper-pressing plate 29 by removing the upper ornamental panel 74.

While the invention has been described in detail with reference to the above-described embodiments thereof, it would be apparent to those skilled in the art that various changes and modifications may be made therein without departing from the spirit of the invention.

In the first through fourth embodiments, the covers 11 and 12 may be modified to be detachably mounted on the casing 2 similarly to the ornamental panels 74 and 75 of the fifth embodiment.

In the fifth embodiment, the ornamental panels 74 and 75 may be modified to be rotatably supported by the shafts 13 and 14 similarly to the covers 11 and 12.

In the fifth embodiment, the ventilating fan set 72 may not be provided in the casing 2. In this case, the cover plate 78 may not be formed with the outlet 80, and the cover plate 79 may not be formed with the inlet 82.

In the fifth embodiment, only one of the upper and lower cover plates 78 and 79 may be covered with a corresponding ornamental plate 84 or 85.

The upper and lower ornamental panels 74 and 75 may be integrated together into a single ornamental panel.

In the fifth embodiment, each of the upper and lower ornamental plates 84 and 85 is formed of a material selected from wood, fibers, and foam material. However, each of the upper and lower ornamental plates 84 and 85 may be formed of a material other than wood, fibers, or foam material, as long as a plurality of through-holes passes through the material in the front-to-rear direction, that is, the thickness direction, to enable air communication between the inside and the outside of the printer 401.

In each of the first through fourth embodiments, the four process units 33, 133, 233, or 333 and four scanning units 34, 134, 234, or 334 are provided in the casing 2 to form a full color image. However, it is sufficient that two or more process units and at least one scanning unit be provided in the casing 2. In this case, each scanning unit may be used to scan one or more laser beam onto corresponding one or more process unit 33.

In the fifth embodiment, the four process units 33 and four scanning units 34 are provided in the casing 2 to form a full color image. However, it is sufficient that at least one process unit 32 and at least one scanning unit 34 be provided in the casing 2. When two or more process unit 33 and at least one scanning unit 34 are provided in the printer 1, the printer 1 forms a multicolor image. In this case, each scanning unit 34 may be used to scan one or more laser beam onto corresponding one or more process unit 33. When only one process unit 33 and only one scanning unit 34 are provided in the printer 1, the printer 1 forms a monochromatic image.

In the first through fourth embodiments, both of the upper and lower covers 11 and 12 are provided in the front surface 6 of the casing 2. However, only one of the upper and lower covers 11 and 12 may be provided in the front surface 6 of the casing 2. Still in this case, the rear wall 7 of the casing 2 is preferably flat. By making flat a side of the casing 2 that is opposite to the side of the casing where a cover is provided, it is possible to economize the space.

Similarly, in the fifth embodiment, both of the upper and lower ornamental panels 74 and 75 are provided in the front surface 6 of the casing 2. However, only one of the upper and lower ornamental panels 74 and 75 may be provided in the front surface 6 of the casing 2. Still in this case, the rear wall 7 of the casing 2 is preferably flat. By making flat a side of the casing 2 that is opposite to the side of the casing where a panel is provided, it is possible to economize the space.

What is claimed is:

1. An image-forming device comprising:

a casing;

an image-forming section including a plurality of image-forming units that are arranged substantially vertically within the casing, each image-forming unit forming an image in a corresponding color;

a paper supply unit disposed above the image-forming units, the paper supply unit being configured to accommodate a recording medium substantially in a vertical orientation and to supply the recording medium to the image-forming section;

a discharge unit disposed above the image-forming units, the discharge unit being configured to receive the recording medium discharged from the image-forming section substantially in a vertical orientation; and a conveying path that is configured to convey a recording medium supplied from the paper supply unit vertically downward, around the lowermost image-forming unit, then vertically upward toward the discharge unit, the recording medium receiving the images from the image-forming units while being conveyed along the conveying path.

2. An image-forming device according to claim 1, wherein each image-forming unit is configured to be mounted in and removed from the casing in a thickness direction of the recording medium that is stacked in the paper supply unit and discharge unit.

3. An image-forming device according to claim 1, further comprising a widthwise moving unit that is configured to move the casing, the moving unit moving the casing in only a widthwise direction that is orthogonal to the direction that the recording medium is stacked in the paper supply unit and the discharge unit and orthogonal to the vertical direction.

4. An image-forming device according to claim 1, further comprising a position adjusting unit that adjusts the position of the casing vertically.

5. An image-forming device according to claim 1, further comprising:

a first shaft provided on the casing, the first shaft extending along a widthwise direction orthogonal to the direction that the recording medium is stacked in the paper supply unit and the discharge unit and orthogonal to the vertical direction; and a first cover disposed on the casing and capable of pivoting about the first shaft, the first cover covering or exposing at least a portion of the paper supply unit and the discharge unit.

6. An image-forming device according to claim 5, further comprising:

a second shaft provided on the casing, the second shaft extending along the widthwise direction orthogonal to the direction that the recording medium is stacked in the paper supply unit and the discharge unit and orthogonal to the vertical direction; and a second cover disposed on the casing and capable of pivoting about the second shaft, the second cover covering or exposing at least a portion of the image-forming units.

7. An image-forming device according to claim 1, further comprising:

a first cover pivotably disposed on the casing and covering or exposing at least a portion of the paper supply unit and the discharge unit; and a second cover pivotably disposed on the casing and covering or exposing at least a portion of the image-forming units;

wherein the first cover is disposed above the second cover.

8. An image-forming device according to claim 7, wherein the first and second covers are disposed on the same side surface of the casing.

9. An image-forming device according to claim 7, wherein the casing has a flat wall on its side surface opposite to a side surface on which at least one of the first cover and the second cover is disposed.

10. An image-forming device according to claim 1, further comprising a control panel disposed on a top surface of the casing.

11. An image-forming device according to claim 1, further comprising a fixing unit disposed in the casing above the image-forming units and below the discharge unit, the fixing unit being configured to fix images formed on the recording medium in the image-forming units.

12. An image-forming device according to claim 1, wherein each image-forming unit comprises a photosensitive member that forms an electrostatic latent image;

further comprising a plurality of exposure units, each being provided in correspondence with one image-forming unit and exposing the photosensitive member in the subject image-forming unit;

wherein each of the image-forming units and each of the exposure units are located alternately in a vertical direction.

13. An image-forming device according to claim 1, wherein the paper supply unit and the discharge unit confront each other at a distance in a horizontal direction.

14. An image-forming device according to claim 1, wherein the image-forming section further includes a conveying unit disposed in a vertical arrangement confronting the image-forming units and configured to convey the recording medium, the recording medium receiving the images from the image-forming units while being conveyed by the conveying unit.

15. An image-forming device according to claim 14, wherein the conveying unit is disposed in a position vertically opposing the discharge unit.

16. An image-forming device according to claim 1, wherein the image-forming section further includes an intermediate transfer unit arranged vertically in confrontation with the image-forming units, the intermediate transfer unit being configured to carry images superposed by the image-forming units and to transfer the superposed images onto a recording medium.

17. An image-forming device according to claim 16, wherein the intermediate transfer unit opposes the discharge unit vertically.

18. An image-forming device according to claim 1, wherein the image-forming units are detachably mounted in the casing, further comprising a cover disposed on the casing to cover or expose a side surface of the casing, the cover being configured to facilitate the mounting and removal of the image-forming units with respect to the casing through the exposed side surface, wherein the casing defines a curved path, a part of which follows the side surface that is covered or exposed by the cover, the image-forming units being mounted in and removed from the casing along the curved path through the exposed side surface.

19. An image-forming device according to claim 1, further comprising a cover disposed on the casing to cover a side surface of the casing, the cover having a cover layer formed of a material selected from the group consisting of wood, fibers, and foam material.

20. An image-forming device according to claim 19, wherein the cover further has a support layer that is mounted on at least a portion of the casing and that supports the cover layer.

21. An image-forming device according to claim 20, wherein the support layer is configured to cover or reveal the inside of the casing.

22. An image-forming device according to claim 21, wherein the support layer has a ventilation through-hole formed therein and allowing the passage of air between the interior and exterior of the casing; and the cover layer has a plurality of through-holes formed through the thickness direction thereof.

23. An image-forming device according to claim 22, further comprising a fan mounted in the casing at a position corresponding to the ventilation through-hole.

24. An image-forming device according to claim 1, wherein a cover is detachably mounted on the casing.

* * * * *